US008764536B2

(12) United States Patent
Sparago

(10) Patent No.: US 8,764,536 B2
(45) Date of Patent: Jul. 1, 2014

(54) CARD GAME COMBINING ELEMENTS OF BLACKJACK AND PAI GOW

(71) Applicant: Score Gaming LLC, Los Angeles, CA (US)

(72) Inventor: Merrill Sparago, Los Angeles, CA (US)

(73) Assignee: Score Gaming LLC, Los Angeles, CA (US)

( * ) Notice: Subject to any disclaimer, the term of this patent is extended or adjusted under 35 U.S.C. 154(b) by 102 days.

(21) Appl. No.: 13/631,388

(22) Filed: Sep. 28, 2012

(65) Prior Publication Data

US 2013/0079084 A1 Mar. 28, 2013

Related U.S. Application Data

(60) Provisional application No. 61/540,222, filed on Sep. 28, 2011.

(51) Int. Cl.
*G07F 17/32* (2006.01)
*A63F 1/00* (2006.01)

(52) U.S. Cl.
CPC ..... *G07F 17/326* (2013.01); *G07F 17/3293* (2013.01); *A63F 2001/003* (2013.01); *A63F 2001/005* (2013.01)
USPC ..... 463/12; 463/13

(58) Field of Classification Search
CPC ..... A63F 2001/003; A63F 2001/005; G07F 17/326; G07F 17/3293
USPC ..... 436/12, 13
See application file for complete search history.

(56) References Cited

U.S. PATENT DOCUMENTS

| | | | | |
|---|---|---|---|---|
| 5,294,128 | A * | 3/1994 | Marquez | 273/292 |
| 5,653,444 | A | 8/1997 | Dahl | |
| 5,660,391 | A | 8/1997 | Klasee | |
| 5,660,393 | A | 8/1997 | Dreger | |
| 5,673,917 | A | 10/1997 | Vancura | |
| 5,685,774 | A | 11/1997 | Webb | |
| 5,863,041 | A | 1/1999 | Boylan et al. | |
| 5,863,042 | A | 1/1999 | Lo | |
| 6,007,424 | A | 12/1999 | Evers et al. | |
| 6,113,103 | A | 9/2000 | Mostashari | |
| 6,179,293 | B1 * | 1/2001 | Hedman | 273/292 |
| 6,227,969 | B1 | 5/2001 | Yoseloff | |

(Continued)

OTHER PUBLICATIONS

Ayecarumba, Funtazee 21, forum post, May 12, 2011, http://wizardofvegas.com/forum/gambling/blackjack/5341-funtazee-21/.

*Primary Examiner* — Corbett B Coburn
(74) *Attorney, Agent, or Firm* — Endurance Law Group, PLC

(57) ABSTRACT

A wagering card game, optionally electronically implemented, combines variations of Pai Gow and Blackjack. Player(s) and a dealer are each dealt five cards from a standard deck of 52 playing cards. The player and dealer arrange their respective five cards into a three-card high hand and a two-card low hand, provided the numerical sum of the high hand does not exceed 21. To win the game the player must have a higher numeric value in both their high and low hands as compared to the dealer's high and low hands. A special high rank is ascribed to a high hand having a sum of 21 achieved through the combination of two ten-valued cards and one Ace. An option side wager is won by the player if the numerical sums of the player's high and low hands match.

9 Claims, 22 Drawing Sheets

(56) References Cited

U.S. PATENT DOCUMENTS

| | | | | |
|---|---|---|---|---|
| 6,443,455 | B1 | 9/2002 | Webb | |
| 6,702,289 | B1 | 3/2004 | Feola | |
| 6,793,220 | B1 | 9/2004 | Feola | |
| 7,159,869 | B2 | 1/2007 | Pastirik | |
| 2001/0015529 | A1 | 8/2001 | Allen | |
| 2003/0114209 | A1 | 6/2003 | Ritner et al. | |
| 2004/0000758 | A1* | 1/2004 | Yurkins | 273/292 |
| 2004/0164491 | A1* | 8/2004 | Webb | 273/274 |
| 2005/0170875 | A1 | 8/2005 | Snow | |
| 2005/0269774 | A1 | 12/2005 | Sorge | |
| 2006/0084505 | A1 | 4/2006 | Yoseloff et al. | |
| 2006/0244218 | A1 | 11/2006 | Frankel et al. | |
| 2007/0018405 | A1 | 1/2007 | Au-Yeung | |
| 2007/0111786 | A1 | 5/2007 | Snow | |
| 2007/0194533 | A1 | 8/2007 | Brunelle | |
| 2008/0073846 | A1 | 3/2008 | Lo | |
| 2008/0169606 | A1 | 7/2008 | Smith et al. | |
| 2008/0191417 | A1 | 8/2008 | Pham | |
| 2008/0252013 | A1 | 10/2008 | Tang | |
| 2009/0224480 | A1 | 9/2009 | Tang | |
| 2009/0295087 | A1 | 12/2009 | Kling et al. | |
| 2011/0198809 | A1 | 8/2011 | Sparago | |

* cited by examiner

CARD GAME COMBINING ELEMENTS OF BLACKJACK AND PAI GOW

CROSS REFERENCE TO RELATED APPLICATIONS

This application claims priority to Provisional Patent Application No. 61/540,222 filed Sep. 28, 2011, the entire disclosure of which is hereby incorporated by reference and relied upon.

BACKGROUND OF THE INVENTION

1. Field of the Invention

The present invention relates to a card game playable in live and electronic formats, and more specifically to a modified version of the traditional casino card games blackjack or twenty-one and Pai Gow.

2. Related Art

Casinos are constantly looking for new games to expand the options for play. Pai Gow poker is a popular casino card game, adapted from the Chinese tile game Pai Gow (or Pai Gao). Pai Gow was turned into a casino style poker game by inventors Sam Torosian and Fred Wolf. Since then the game has become a staple in major casinos throughout the world with multiple variations to add excitement and diversity to the game. Casinos are always looking for modified games that provide excitement, variety, and value for the casino.

Pai Gow poker is either a player or house banked game in which the dealer and the player are both dealt seven cards. The object of the game is to divide the seven cards into two poker hands consisting of five cards (the "High" hand), and two cards (the "Low" hand). The High hand must be of a Higher poker ranking than the Low hand for the hands to be played. After the player divides their cards into a High and Low hand, the dealer reveals their cards and arranges them into a High, five card hand, and a Low, two card hand. The dealer arranges their cards per predetermined rules set by the house.

In order to win a round of Pai Gow, the player's High hand and Low hand must both beat the dealer's respective High hand and Low hand. If the player's High hand beats the dealer's High hand, but the player's Low hand does not beat the dealer's Low hand this is considered a push and the player retains their initial wager. The same is true if the player's Low hand beats the dealer's Low hand but the player's High hand does not beat the dealer's High hand. In the event the dealer's High hand and Low hand outrank the player's respective High hand and Low hand this is considered a loss and the bet is forfeited to the house.

Pai Gow, though gaining in popularity, is intimidating to some as it is somewhat difficult to break the seven cards into a five-card and a two-card hand making it a hard game for some players to learn. Five card Pai Gow games have been proposed as a somewhat easier version of the traditional game.

The inventor's own U.S. Patent Publication No. 2011/0198809 titled "Pai Gow Card Game with Side Bet Options" describes a method of playing Pai Gow poker with 5 cards rather than the traditional 7, and the inclusion of a novel side wager based on the game of blackjack or 21. The entire disclosure of U.S. Patent Publication No. 2011/0198809 is hereby incorporated by reference and relied upon. The side wager and the main Pai Gow wager are resolved independently. However, the main wager and side wager are further unique in that the player can incorporate strategy to make it more likely that the player win the main Pai Gow wager, the blackjack side wager, or both.

Other examples of 5-Card Pai Gow (or Pai Gao) games including bonus/side bet wagers may be found. US 2003/0114209 to Ritner, Jr. et al. discloses a 5-card Pai Gao game where the cards are divided between a three card High hand and a two card Low hand. A bonus feature considers all 5-cards against a poker-style pay table. US 2009/0224480 to Tang discloses a Pai Gao game wherein the traditional seven cards are divided into three hands rather than two (High and Low) hands. The Tang '480 game includes a separate bonus wager. In one variation, a bonus is rewarded for having the lowest possible hands (identified as 9-8-7-6-4-3-2 or 9-8-7-5-4-3-2). Another example is provided by U.S. Pat. No. 5,660,393 Dreger which describes a method of playing a card-based wagering game. An underlying card game (not Pai Gao) includes an optional side bet. The side/bonus game is played by the player making an independent wager on a range of possible cards. One option (identified as the preferred embodiment) enables the selection of a Low numerical value range (e.g., cards with numerical values of 6 or less).

Despite the existence of other game options based, directly or indirectly, on traditional Pai Gow, there remains a need for even better game methods that attract new players, is easy to learn, and that retains players through a compelling combination of rules and wagering options.

SUMMARY OF THE INVENTION

A method of playing a wagering game utilizes one or more decks of standard playing cards. A game playing surface is provided to establish playing positions for a dealer and at least one player. At least one standard deck of 52 playing cards is provided with respective faces designated in ascending numerical sum 2-10, J, Q, K, A each in four suits. A numerical value is assigned to each card. The assigned numerical value is equivalent to the face value for cards designated 2-10, and to ten for cards designated J, Q, K, and to either one or eleven for cards designated A. A primary wager is accepted from the player, and then five cards each are dealt to the player and the dealer respectively. The player and the dealer arrange their respective five cards into a three-card high hand and a two-card low hand, provided that the numerical sum of the high hand does not exceed a value of 21. After all of the high and low hands have been arranged, the numerical sum of the dealer's three-card high hand is compared to the numerical sum of the player's three-card high hand and likewise the numerical sum of the dealer's two-card low hand is compared to the numerical sum of the player's two-card low hand. Settlement of the player's primary wager is dependent upon the comparison of the numerical sum of the dealer's three-card high hand to the numerical sum of the player's three-card high hand and the comparison of the numerical sum of the dealer's two-card low hand to the numerical sum of the player's two-card low hand. The player's primary wager is confiscated if the numerical sum of the dealer's three-card high hand and two-card low hand is higher than the player's three-card high hand and two-card low hand respectively. In contrast, the player is paid a winning payout associated with the primary wager if the numerical sum of the player's three-card high hand and two-card low hand is higher than the dealer's three-card high hand and two-card low hand respectively. Finally, the player is allowed to retain their primary wager if the numerical sum of the player's three-card high hand or two-card low hand, but not both, is higher than the dealer's three-card high hand or two-card low hand respectively.

According to another aspect of this invention, an electronically implemented method of playing the wagering game uses images of playing cards. An electronic gaming machine includes at least one display screen configured to display images of playing cards. The electronic gaining machine includes a non-transitory computer readable medium coded with instructions and executed by a processor to perform the steps of the game method as described above.

The present game method strategically combines disparate elements of traditional Pai Gow and traditional Blackjack in a unique and compelling manner that attracts new players, that is easy to learn, and that retains players for successive rounds of play through a captivating combination of rules and wagering options.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENTS

The game method of this invention is referred to hereafter as "Pai Jack", but it is to be understood that the term Pai Jack is a fanciful name coined by the applicant and used herein for the sake of clarity and brevity. The term Pai Jack not to be construed as a generic or merely descriptive term applicable to the novel game methods described and claimed herein.

Figure 1:
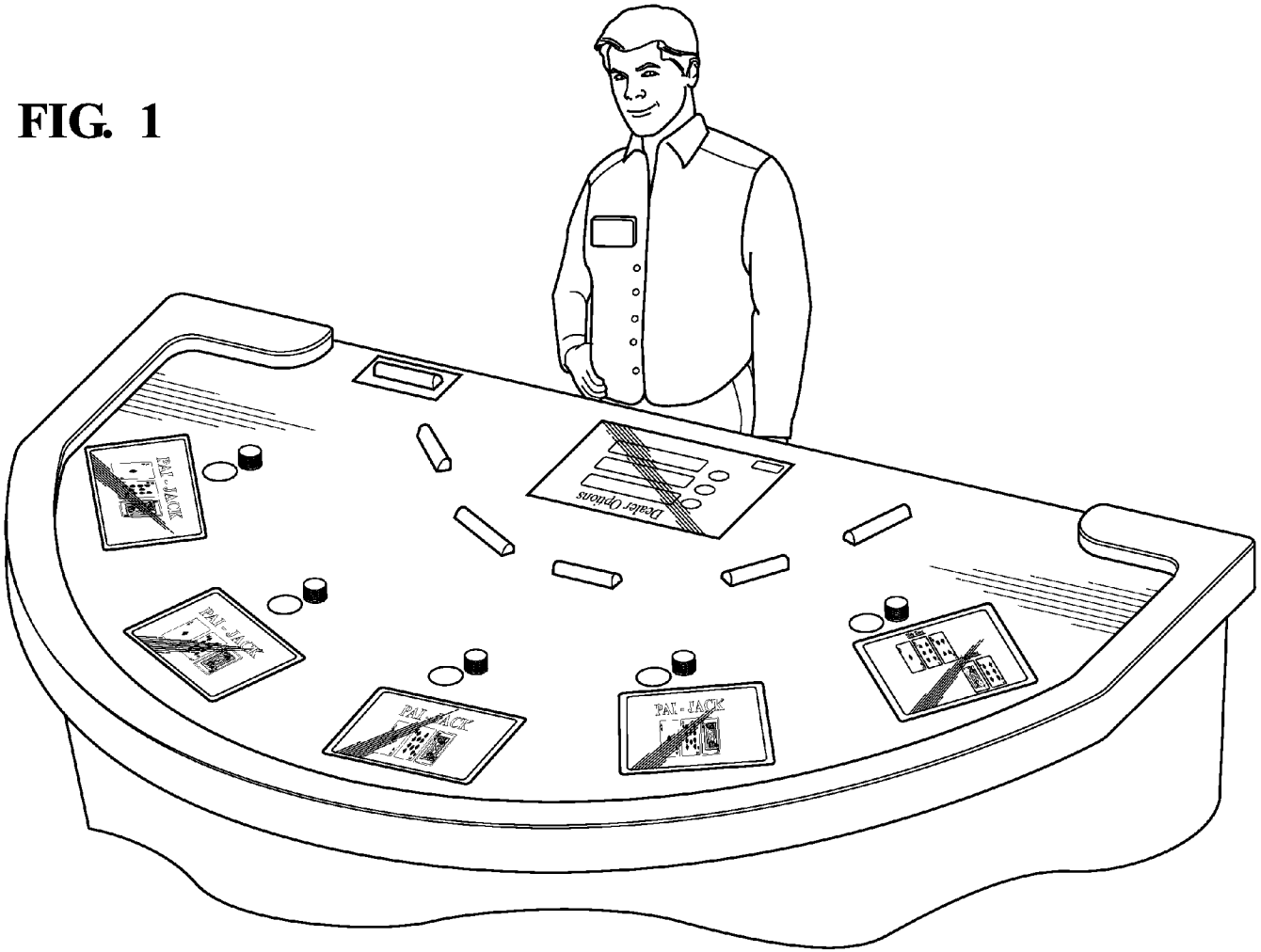
FIG. 1 is an exemplary view of a multi-player live game table having touch-screens embedded in the playing surface at each player station, the system including a computerized controller coded with instructions to execute game methods according to this present invention.

As shown in FIG. 1, the Pai Jack game may be played in a casino-type environment with multiple players concurrently playing in the physical presence of one another in real time against a common dealer representing the casino or "house". The game table of FIG. 1 is of the type having touch-screens embedded in the playing surface at each player station, such as for example the iTable products available from Shuffle Master, Inc. of Las Vegas, Nev., USA. A system like that depicted in FIG. 1 is including a non-transitory computer readable medium coded with instructions and executed by a processor to perform the steps of this present invention. Although the representation in FIG. 1 shows only five player stations, six player stations is actually preferred to be consistent with the traditional game of Pai Gow.

Figure 2:
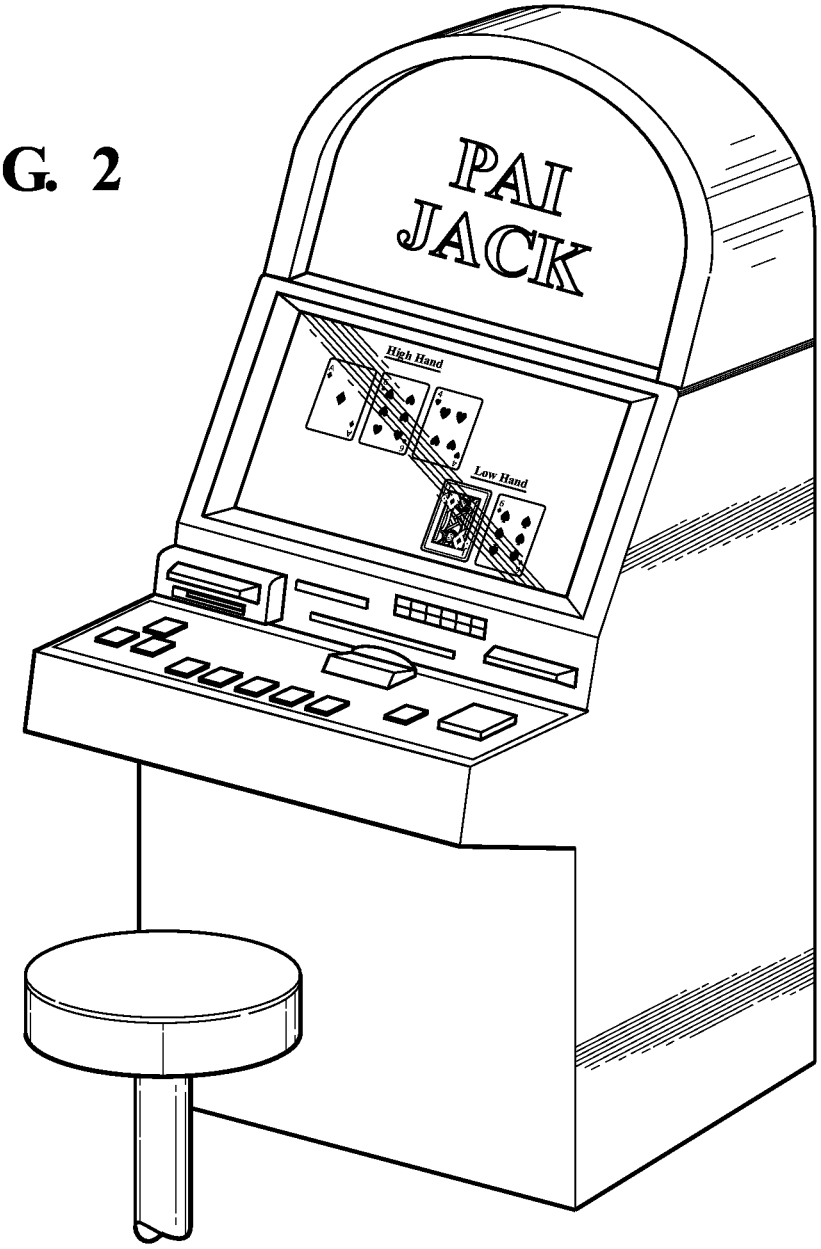
FIG. 2 is an exemplary illustration of an electronic gaming machine configured for single-player use in connection with the present invention.

As shown in FIG. 2, the Pai Jack game can alternatively be played in electronic or virtual format, whereby cards are displayed on a screen and dealt by computer or other electronically triggered system based on available technology. The game programming may simulate a dealer or be configured to live-stream activity from a remotely located dealer.

Figure 3:
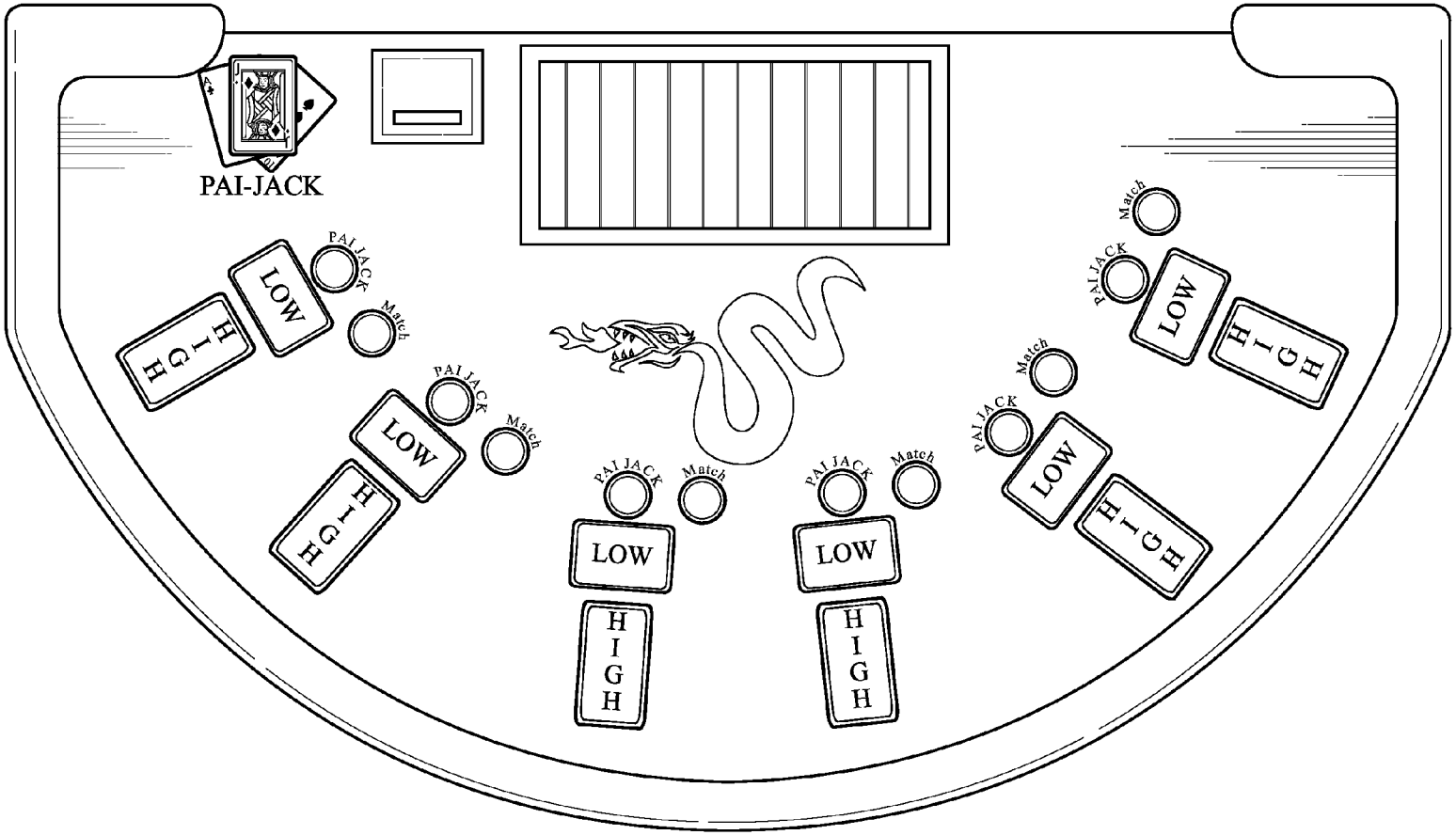
FIG. 3 is an exemplary view of the playing surface of a multi-player live game table configured to facilitate game methods of this invention.

The Pai Jack game may also be played on a standard casino gaming table using a live dealer and a single player or multiple players, as shown in the exemplary layout of FIG. 3. In this scenario, playing cards may be dealt by dealer hand or via an automated dealing machine. Included in the layout are spaces designated for the dealer and 6 players. Areas to set high high and low hand are demarcated. Two wagers are shown: the primary Pai Jack main wager and an optional Match side wager. At each player betting station, areas to place cards into high and low hands are demarcated.

Method of Dealing

Figure 4:
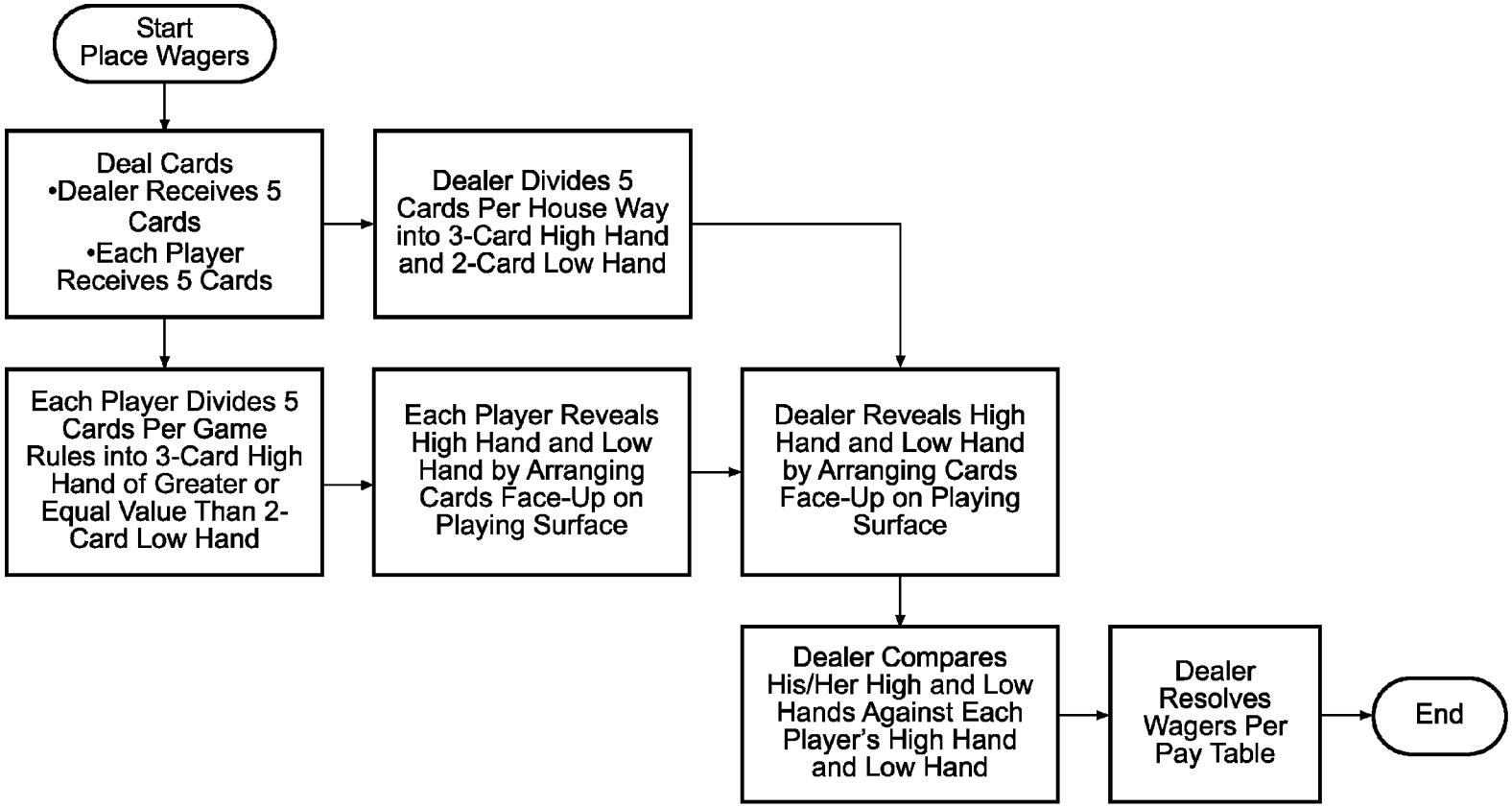
FIG. 4 is a simplified flow diagram providing an overview of the game method play according to one embodiment of the present invention.

The method of play is shown schematically in FIG. 4. A round of Pai Jack begins when a player(s) places a single Pai Jack wager in a designated spot on the Pai Jack playing surface. A dealer deals each player and themself 5 cards from a single standard deck of 52 playing cards. Jokers are taken out of the deck and are not used in the play of Pai Jack. This is consistent with the game of blackjack which does not use jokers. The cards are preferably dealt in groups of five, either manually, or from an automated dealing machine, or in virtual format. The player cards are dealt face down. The dealer cards are also dealt face down after each player receives their cards.

In the event there are multiple players at the table, dealing may begin with the player on the dealer's immediate left and move in a clockwise fashion until all players and then the dealer receive their cards, consistent with standard blackjack. Alternatively, dealing may also begin with a randomly chosen player through use of an automated random number generator as in the traditional game of Pai Gow. The random number generator displays a number 1-6 which corresponds to the six player seats at the Pai Gow table. The dealer begins with the player whose seat number is displayed on the number generator. All cards are dealt face down in groups of five as in the prior method. The dealer will then distributed cards in a clockwise fashion until the dealer and all of the remaining players at the table have a hand of 5 cards.

In any case, the remaining cards in the deck are discarded and are not used in the remainder of that round of play. As an example, if there are three players and a dealer at the table, 20 cards would be removed from the deck in order to make a 5-card hand for each person. The remaining 32-cards are discarded as per the traditional game of Pai Gow.

The dealing procedure may be altered as per casino/house rules. In other words, the casino/house may decide which dealing method they choose.

Method of Setting Hands

Figure 5:
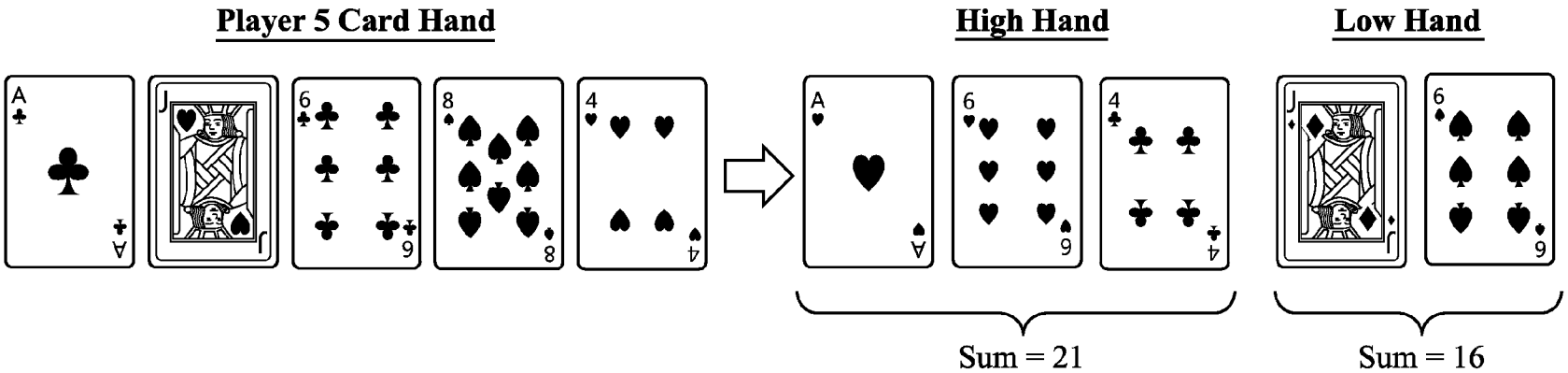
FIG. 5 is an exemplary depiction of a player's original 5-card hand which is the divided into a high hand and a low hand according to the rules of the present method.

The object of the present Pai Jack game is to divide the initial 5-card hand into a 3-card high hand and a 2-card low hand where the player tries to reach, but not exceed, a numerical sum total of 21 in each individual hand. The numeric value of the high hand must exceed or equal the numeric value of the low hand. The player can set their hand in any way as long as the high hand is of equal or higher value than the low hand. FIG. 5 provides an exemplary depiction of a player's original 5-card hand (A-J-6-8-4) which is the divided into a high hand (A-6-4) and a low hand (J-6), where the total of the high hand is greater than the low hand. In this example, the numeric value of the high hand is 21 and the numeric value of the low hand is 16.

Per player choice, three of the five original cards will always comprise the high hand and the remaining two cards (i.e. the two cards out of five that were not placed in the high hand) will always comprise the low hand. Once hands are set they cannot in general be reset unless the house/casino allows a player to reset their hands.

In another example (not shown), a player is dealt a 5-card hand consisting of a 10, 9, 6, 5, and a 4. The player may choose to divide these 5-cards into a high hand that consists of a 10, 6, and 5 (three cards in the high hand) for a total of 21, and place the remaining two cards of 9 and 4 in the low hand for a total of 13.

Figure 6:
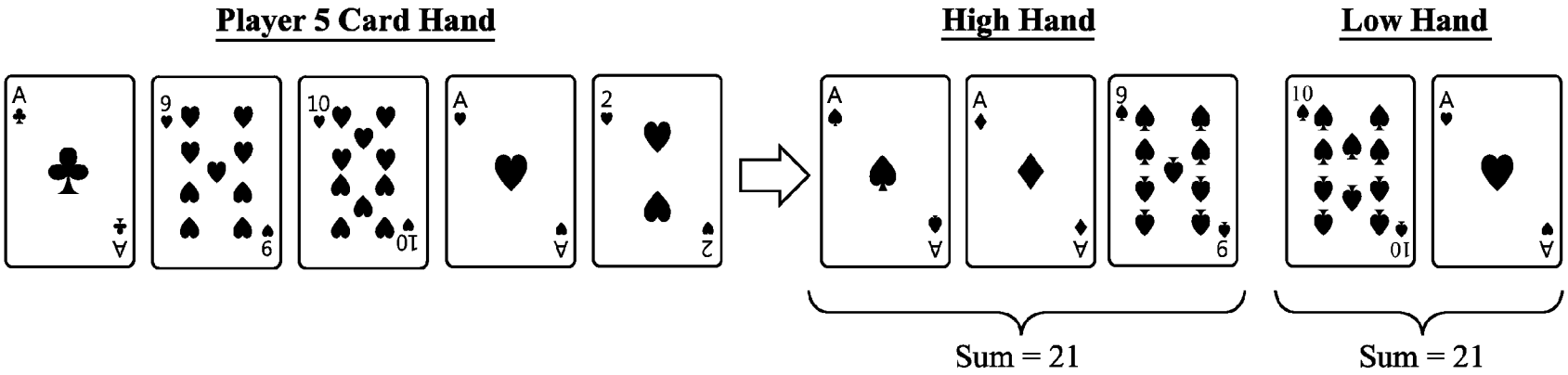
FIG. 6 is an exemplary depiction of a player's original 5-card hand which is the divided into a high hand and a low hand, where the total of the high hand is equal to the low hand.

FIG. 6 illustrates an example where a player's original 5-card hand (A-9-10-A-2) is the divided into a high hand (A-A-9) and a low hand (10-A), where the numeric total of the high hand (21) is equal to that of the low hand (21). In another example (not shown) where the numeric total of the high hand equals the total of the low hand, a 5-card hand of ten, ten, nine, six, three could be played by placing the ten, six, and three in the high hand for a total of 19, and the other ten and nine in the low hand for a total of 19.

Unlike standard blackjack, players do not have the option of hitting to obtain more cards in attempts to better their hand. This is consistent with the rules of Pai Gow in which players are not permitted to take additional cards to better their poker hands.

Fouled Hands

The rules of the present Pai Jack game require that the numeric value of the high hand must be of greater or equal value to the low hand. If the player sets their hand such that the numeric value of the low hand exceeds the numeric value of the high hand this would be considered a foul.

Figure 7:
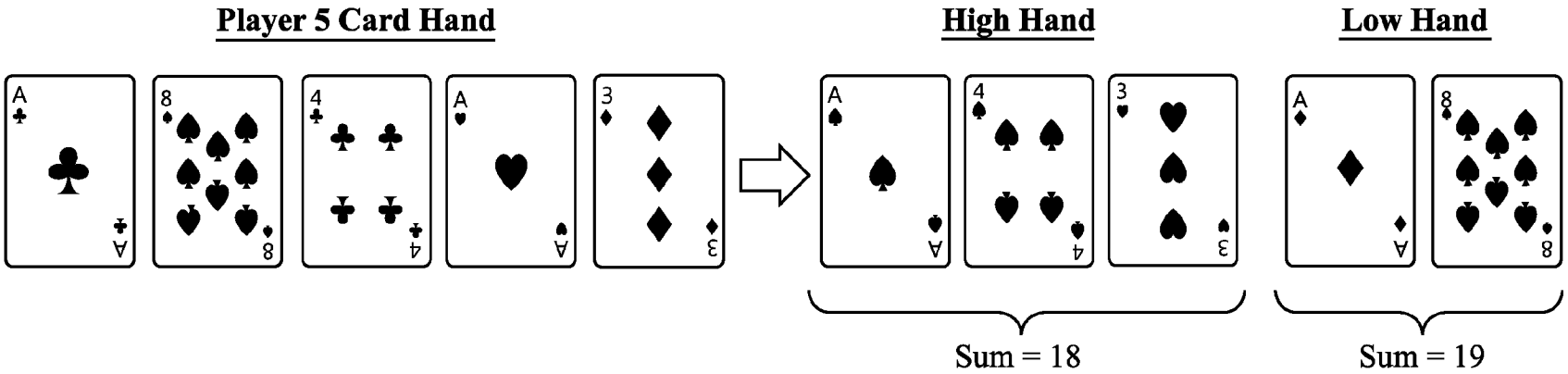
FIG. 7 is an exemplary depiction of a foul where a player's original 5-card hand is divided into a high hand and a low hand, where the total of the high hand is less than the low band.

FIG. 7 for example depicts a foul where a player's original 5-card hand is divided into a high hand and a low hand, where the total of the high hand is less than the low hand. Here the high hand has a numeric value of 18 whereas the value of the low hand is 19. In another example (not shown), given a 5-card hand of ten, ten, ten, 5 and 3, an example of a foul would be setting the high hand at 18 (10, 5, 3) and a low hand set at 20 (10, 10). In this latter case, the low hand outranks the total of the high hand (20 versus 18).

Hands that are set as a foul would generally be a loss for the player and their wager would be forfeited. However the house may allow the player, if possible given the composition of the original 5-cards to reset fouls to conform to the rule of Pai Jack where the high hand is of equal or higher value than the low hand.

Method of Determining and Resolving Busted Hands

In certain instances, the player and/or the dealer may receive a 5-card hand that cannot be divided into two hands where the total of the high hand does not exceed 21. Since the highest value of a two card hand is 21 (Ace and a Ten Valued Card), the two card low hand by definition can never exceed 21.

Figure 8:
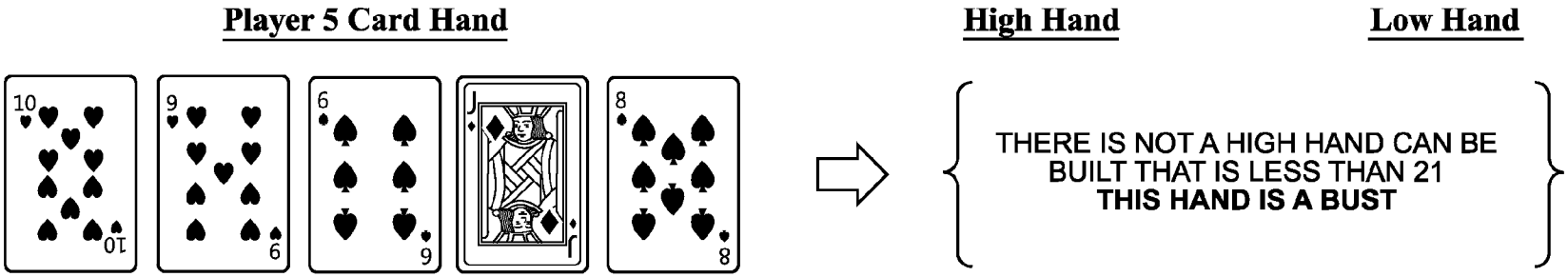
FIG. 8 is an exemplary "busted" 5-card hand as it cannot be divided into a high hand that has a total of less than or equal to 21.

FIG. 8 shows an example of a "busted" 5-card hand (10-9-6-J-8) that cannot be divided into a high hand that has a total of less than or equal to 21. The smallest possible 3-card combination given this hand would have a numeric value of 23 (9+6+8).

In another example (not shown), if a player or dealer receives a 5-card hand comprised of 10, 10, 10, nine, and seven, there is no three card combination that can be extracted from the original 5-card hand where the total of the high hand does not exceed 21 (10+10+10=30 or 10+9+7=26).

All hands that cannot be used to form a high hand less than or equal to 21 are considered a "bust". Like in blackjack, where players lose their initial wager if they bust, players who bust in this Pai Jack game will also lose their initial wager.

Method of Revealing Hands

In the Pai Jack game, each player reveals their high hand and low hand by placing their cards face-up in designated spots on the live or virtual table. Three cards of the five original cards will always comprise the high hand and the remaining two cards will always comprise the low hand. Players preferably reveal their hands before the dealer reveals his/her hand. After all players have revealed their hands, the dealer checks for busted hands.

If a player busts, they automatically lose their initial primary wager before the dealer exposes and sets their cards. The dealer removes the player's cards and collects the player's wager. After all busted hands and wagers are resolved; the dealer reveals and sets their high hand and low hand by placing them face up in designated spots on the live or virtual table. If the dealer busts, all players who remain in the game (i.e. did not bust) win then Pai Tack wager.

Method of Determining the Strength of Hands

In contrast to traditional Pai Gow, which uses poker rankings to determine the strength of the hands, Pai Jack is played using the numerical values of the cards similar to traditional blackjack. Card values in blackjack represent the numeric value of the cards 2-10. Jacks, Queens and Kings also have a value of 10. Aces have a value of 1 or 11 as per the player's decision.

To determine the strength of a blackjack hand, the numeric value of the player's cards is summed together. Hands are ranked in ascending numeric order with the goal of reaching 21. A hand with a total of 18 has a higher value then a hand with a total of 17. Totals that exceed 21 are considered busts and are automatic losers. Therefore, it will be understood that the individual cards are not in themselves used to determine the strength of hands according to this game. Rather, only the sums of the cards in the respective high and low hand are used in determining the strength of hands. Thus a player with an 18 (ex: 10, 5, 3) in their high hand would beat the dealer if the dealer had a 17 (ex: K,A,6) in their high hand. Even though the dealer's hand contains a king and an ace, the player has a higher Pai Jack hand as strength of hands are only determined by summing point totals in each hand and not poker rankings. Similarly, a player with a low hand of 15 (10,5) will beat the dealer's corresponding low hand of 14 (K,4).

In the game of Pai Gow, which uses poker rankings to determine the relative strength of hands, the dealer in the above example has a stronger Pai Gow hand because their hands contains an ace, where the player's highest card is a ten. Such relative poker rankings are not applicable to the present game of Pai Jack as poker rankings do not deter the strength of hands.

"Pai Jack" in the Game Method

In the standard game of blackjack, players who receive a ten valued card and an ace as their initial two cards are considered to have a "blackjack". "Blackjacks" are composed of any ten valued card (i.e. 10, jack, queen or king) and an ace. The ace is ascribed a point value of 11, thus a "blackjack" has a total of 21. Blackjacks are paid at a premium such as 3:2 or 6:5 depending house rules. "Blackjacks" are the strongest hand a player can have in blackjack. Thus a "blackjack" (any 10 valued card and an ace) beats a three or more card combination that sums to 21.

Akin to the traditional game of blackjack, there also exits a highest hand in the Pai Jack game that beats all other hands and can be paid at a bonus. A "Pai Jack" is the strongest hand a player can have in the game of Pai Jack. A "Pai Jack" is comprised of two 10 valued cards and an ace for a total of 21. Here the ace is ascribed a value of 1 (10+10+1=21). Examples of a "Pai Jack" include 10-10-A; 10-Q-A or any other combination of three cards where two cards have a value of ten and the other card is an ace.

Figure 9:
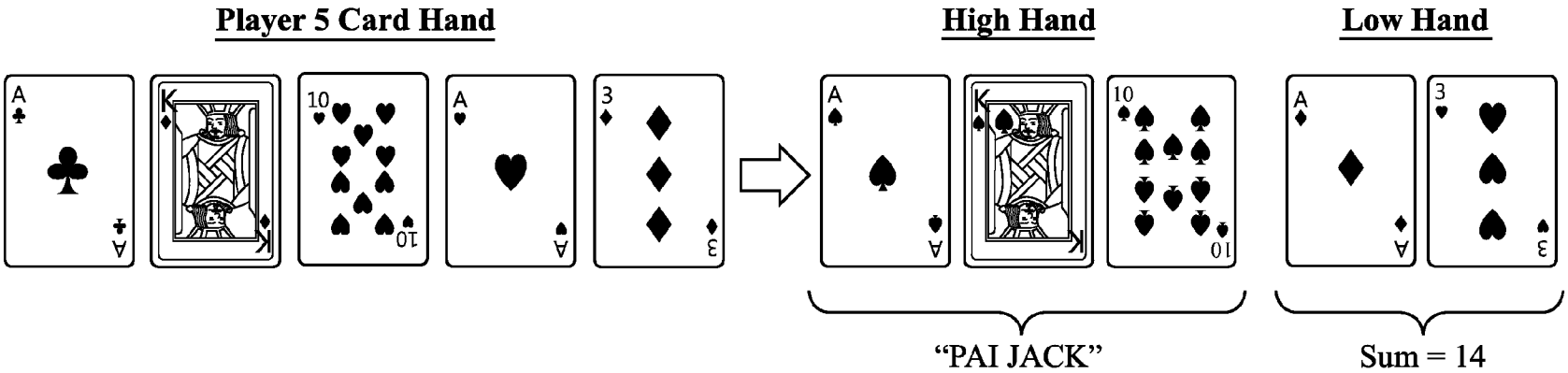
FIG. 9 is an exemplary depiction of a player's original 5-card which is divided into a "Pai Jack" in the high hand and a 14 in the low hand.

FIG. 9 is an exemplary depiction of a player's original 5-card hand which is divided into a "Pai Jack" in the high hand and a 14 in the low hand.

A high hand numerical sum of 21 achieved by any other card combination (e.g., 8-3-10) is the next highest high hand total a player can have in Pai Jack. A "Pai Jack" has a stronger ranking than a sum of 21 achieved by card combinations other than 10-10-A. This is similar to blackjack where a "blackjack" outranks any other 21.

For the low hand, two-card totals of 21 (i.e. any 10 valued card and an ace) are considered a 21 in this Pai Jack game. In other words, a "Pai Jack" can only occur in the 3-card high hand.

Player Automatic Wins/Bonus Hands

If the player has a "Pai Jack" they are automatically paid a bonus of 1:1, independent of the composition of the dealer's high hand. When the dealer later reveals their cards, if the player's low hand also beats the dealer's low hand then the player is paid an extra half unit bonus for a total payout of 3:2. Those of skill will appreciated that payout values are provided as examples only and are subject to the discretion of the house.

Additional bonuses can be built into the Pai Jack wager such as an added payout if the player's "Pai Jack" contains a pair, such as Q-Q-A, or J-J-A. Similarly, a three-card 21 in the high hand that contains a pair could also be paid at a bonus (i.e. 8, 8, 5). Similarly a 5-card hand of 21 could be paid at a bonus as well. Other bonus schemas can be developed using these basic principles that would be readily apparent to those skilled in the art of using five, three, or two cards to create specific combinations.

Method of Setting the Dealer's Hand

Dealers will play their hands according to predetermined rules or what would be generally called the "house way". One preferred method for the house way is for the dealer to divide their 5-cards such that the high hand will be composed of three cards which give the high hand a value closest to, without exceeding, 21. The remaining two cards are placed in the low hand. Said another way, according to one possible implementation the dealer is required to form the high hand with the greatest possible numeric value less than 22 and then place the remaining two cards into their low hand.

Figure 10:
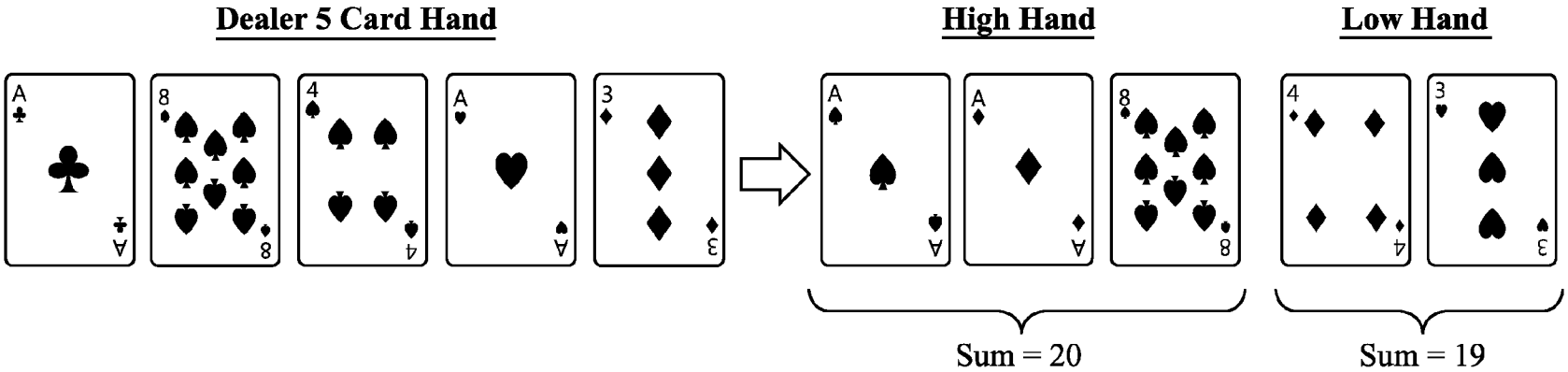
FIG. 10 is an exemplary depiction of a dealer's original 5-card hand that is divided by the preferred method ("house way") into a high hand and a low hand.

FIG. 10 is an exemplary depiction of a dealer's original 5-card hand (A-8-4-A-3) that is divided by the preferred "house way" into a high hand and a low hand, such that the numerical sum of the dealer high hand is 20 (A-A-8, or 11+1+8) and the low hand is composed of the remaining two cards (4-3).

In another example, a 5-card hand of 10, 9, 4, 6, and 3, would be played with the dealer placing the 10, 6, and 4 in the high hand for a total of 20, and the remaining 9 and 3 in the low hand for a total of 12. This gives the dealer the highest, high hand total that can be formed using three of the originally dealt cards of the 5-card hand. The dealer would not set their hand as a 10, 6, 3 in the high hand for a total of 19 and the 9 and 4 in the low hand for a total of 13.

Figure 11:
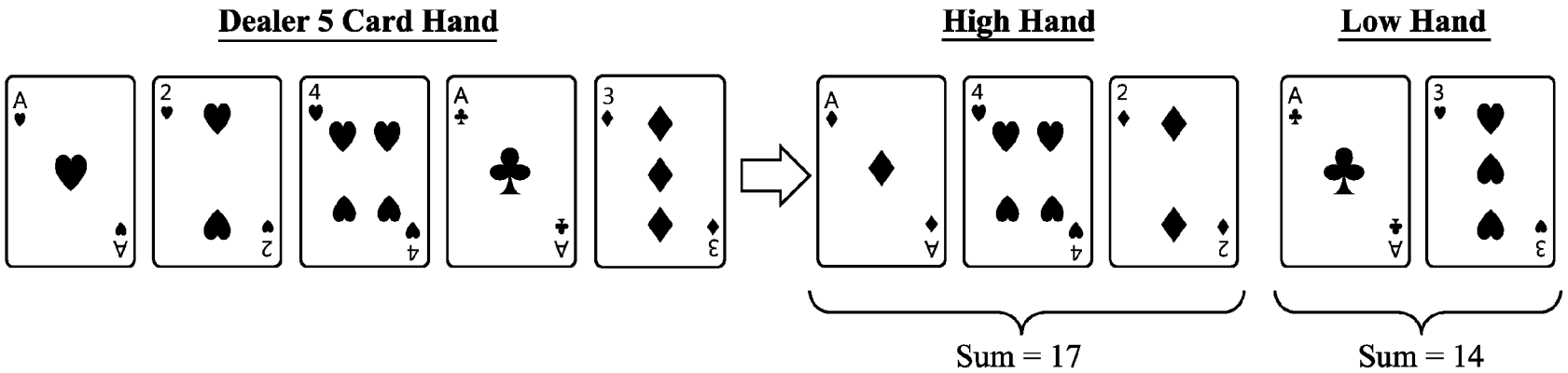
FIG. 11 is an exemplary depiction of a dealer's original 5-card hand that is no divided according to the "house way"
Figure 12:
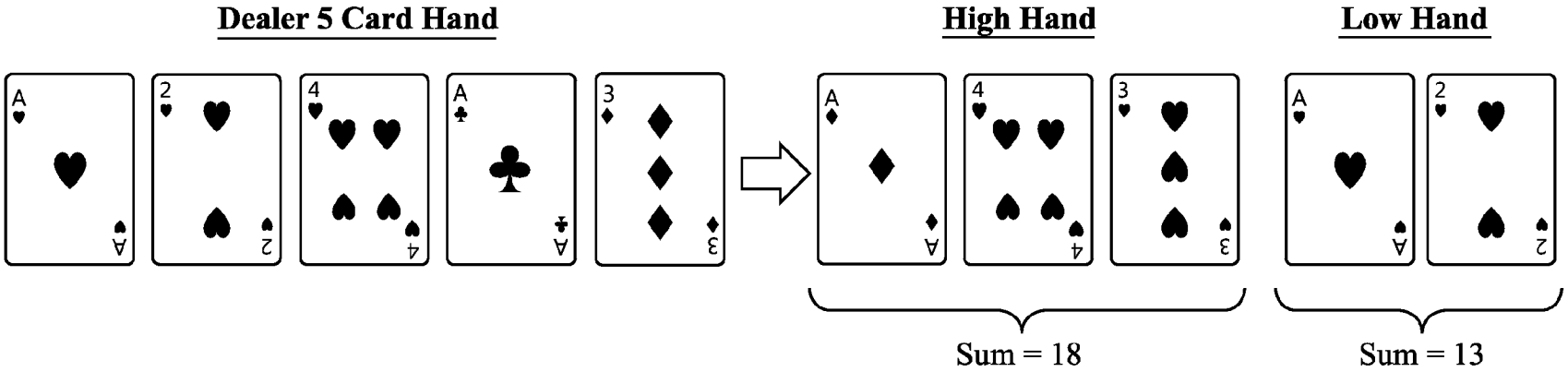
FIG. 12 is an exemplary depiction of the dealer's original 5-card hand as shown in FIG. 11 but dividing the cards into respective high and low hands according to the "house way"

By contrast, FIG. 11 shows a scenario where the dealer does not follow the "house way" when dividing and setting their original 5-card hand (A-2-4-A-3). Here, the dealer's high hand (A-4-2) has a numerical sum of 17. This high hand is not consistent with the "house way" because a different three-card combination of A-4-3 would have yielded a numeric value of 18. FIG. 12 represents the preferred "house way" in comparison to the example of FIG. 11.

Like players, dealers can also get a "Pai Jack" (two 10 valued cards and an ace) in their original 5-card hand. If a dealer has a "Pai Jack", the "Pai Jack" will always be set in the high hand because a "Pai Jack" is the strongest high hand the dealer can have. Regardless of value, the remaining 2-cards are placed in the low hand. So for example if the dealer's original 5-card hand were 3, 6, jack, queen ace, then the dealer would put the "Pai Jack" (Jack, queen, ace) in the high hand and the 3, 6 in the low hand for a total of 9.

Method of Determining the Outcome of the Primary Wager

The method to determine if the player has won, lost, or pushed their Pai Jack wager, will be based on the dealer comparing the strength (numeric value) of the their high hand and low hand against the relative strength (numeric value) of the player's respective high hand and low hand using standard blackjack rankings.

Figure 13:
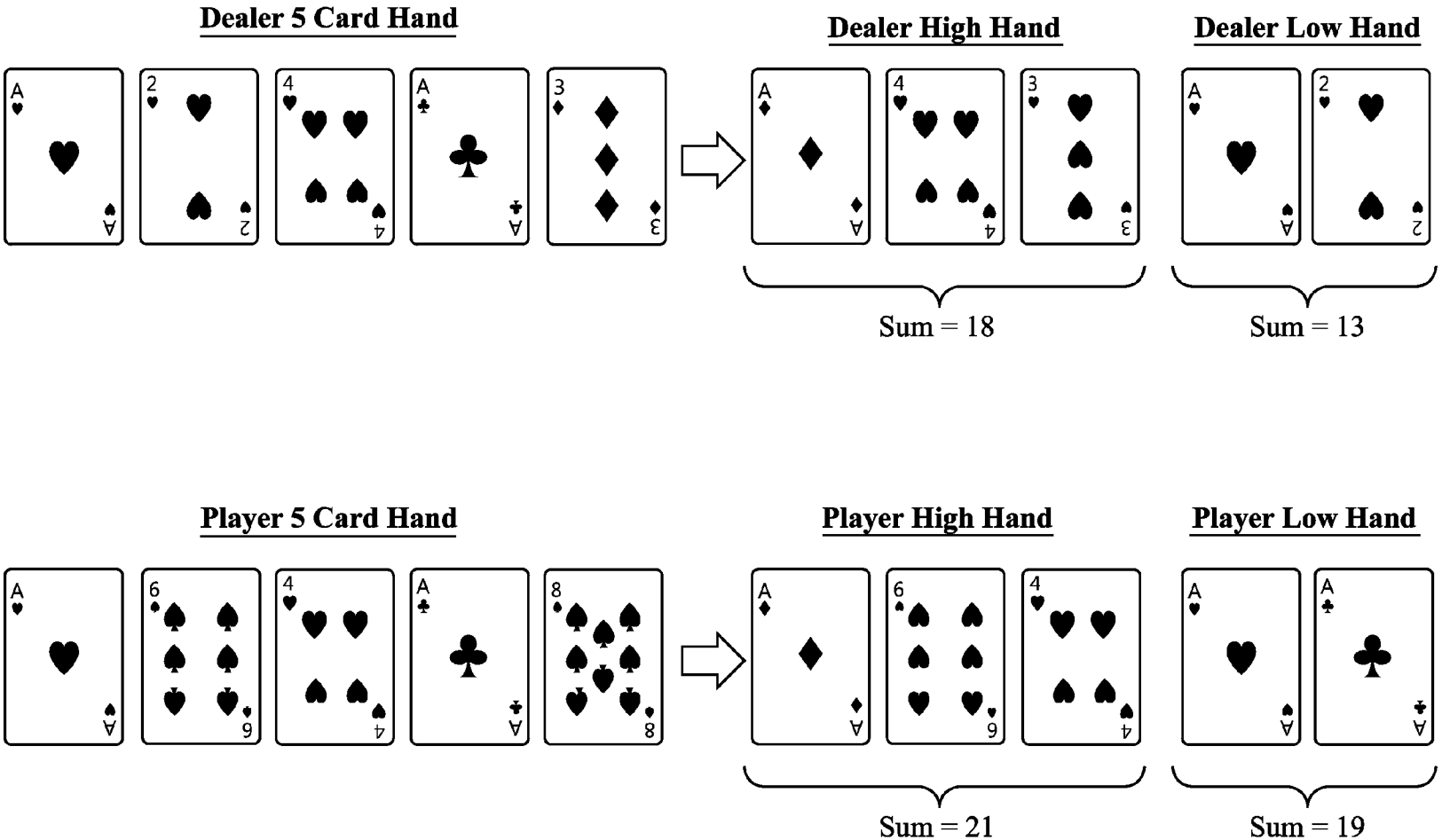
FIG. 13 is an exemplary depiction of a round of the game method of this invention (referred to hereafter as "Pai Jack") where the player's high hand and low hand outrank the dealer's high hand and low hand, resulting in a victory for the player.

In the example of FIG. 13, the player's high hand and low hand outrank the dealer's high hand and low hand. The player, therefore, wins their primary wager, i.e., Pai Jack wager, with an exemplary payout of 1:1.

Figure 14:
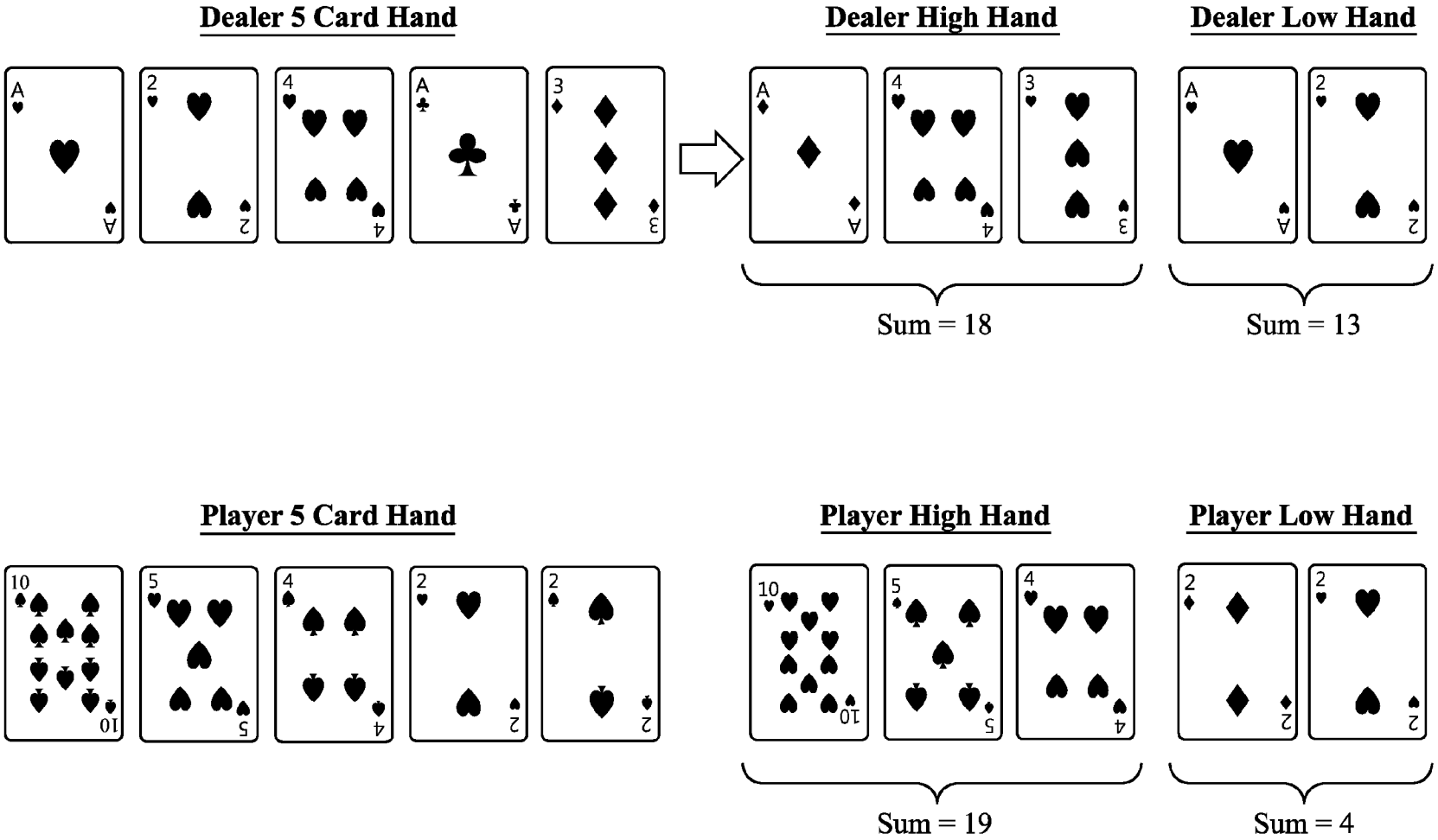
FIG. 14 is an exemplary depiction of a round of Pai Jack where the player's high hand outranks the dealer's high hand and the dealer's low hand outranks the player's low hand, resulting in a push.

In the example of FIG. 14, the player's high hand outranks the dealer's high hand, however the player's low hand is of lesser value than the dealer's low hand. The player, therefore, pushes and their Pai Jack wager is returned.

Figure 15:
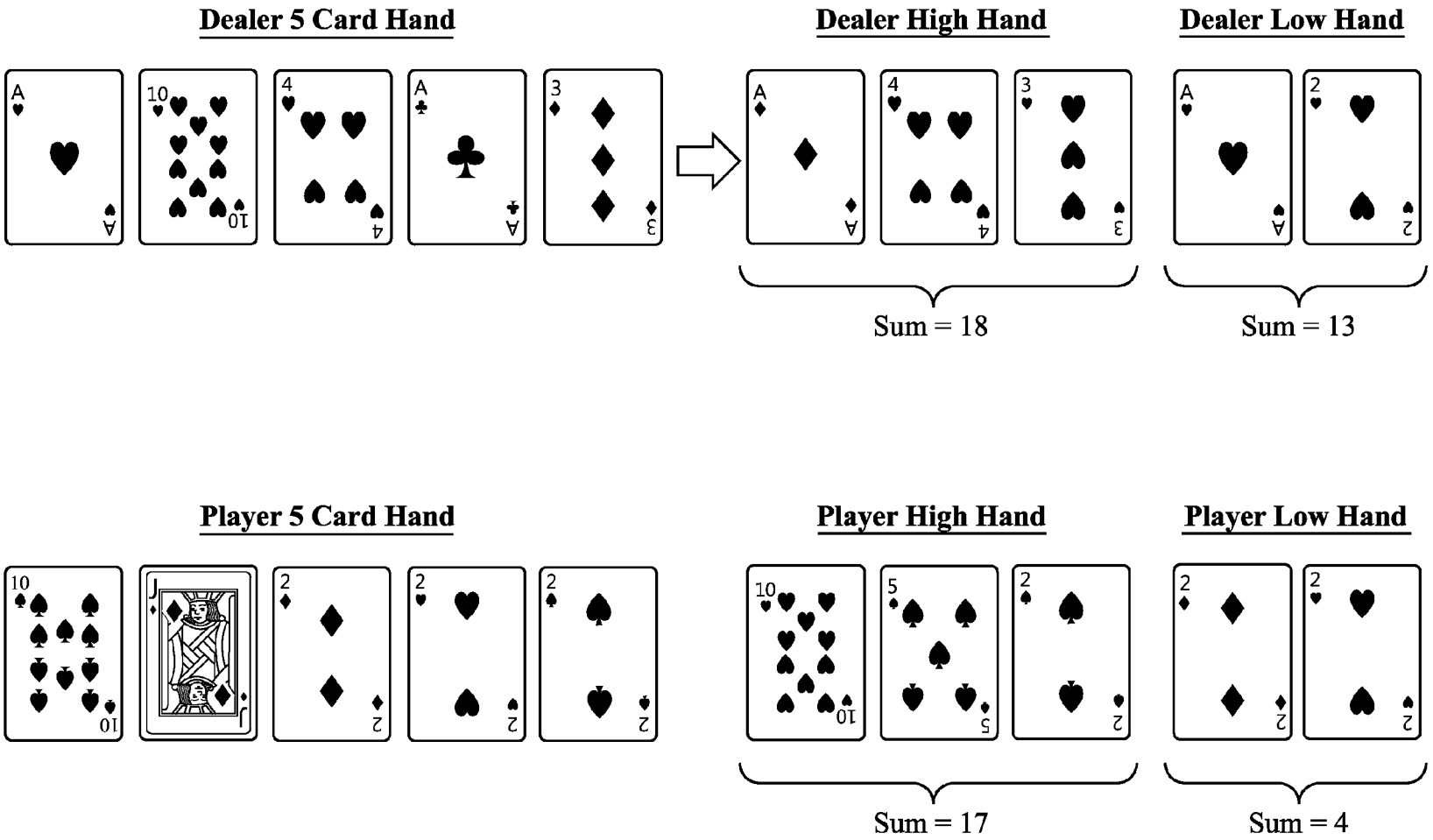
FIG. 15 is an exemplary depiction of a round of Pai Jack where the dealer's high hand outranks the player's high hand and the dealer's low hand outranks the player's low hand, resulting in a victory for the dealer/house.

In the example of FIG. 15, the player's high hand and low hand are of lesser values than the dealer's respective high hand and low hand. The player, therefore, loses their Pai Jack wager.

Player "Pai Jack"

A "Pai Jack" (two 10 valued cards and an ace) has the highest ranking followed by a (non-Pai Jack) 21, 20, 19 (etc) in descending order to a total of 6 (theoretical minimum) in the high hand and 4 (theoretical minimum) in the low hand. As per standard blackjack rankings, 6 is the lowest total for the high hand (2, 2, and 2) and 4 is the lowest total (combination of a 2 and 2).

If the player has a "Pai Jack" they are automatically paid a bonus of 1:1, independent of the composition of the dealer's high hand. The automatic 1:1 bonus will therefore be paid if the dealer also has a "Pai Jack" in their high hand when the player has a "Pai Jack" in their high hand.

A player "Pai Jack" always beats a dealer "Pai Jack". If the player's high hand contains a "Pai jack", and the player's low hand also beats the dealer's low hand, then the player is paid an extra bonus half unit for a total payout of 3:2 on their initial wager. If the player's low hand is of lesser or equal value to the dealer's low hand the player still wins 1:1 on the initial wager for the "Pai Jack" but does not get the extra half unit bonus.

Figure 16:
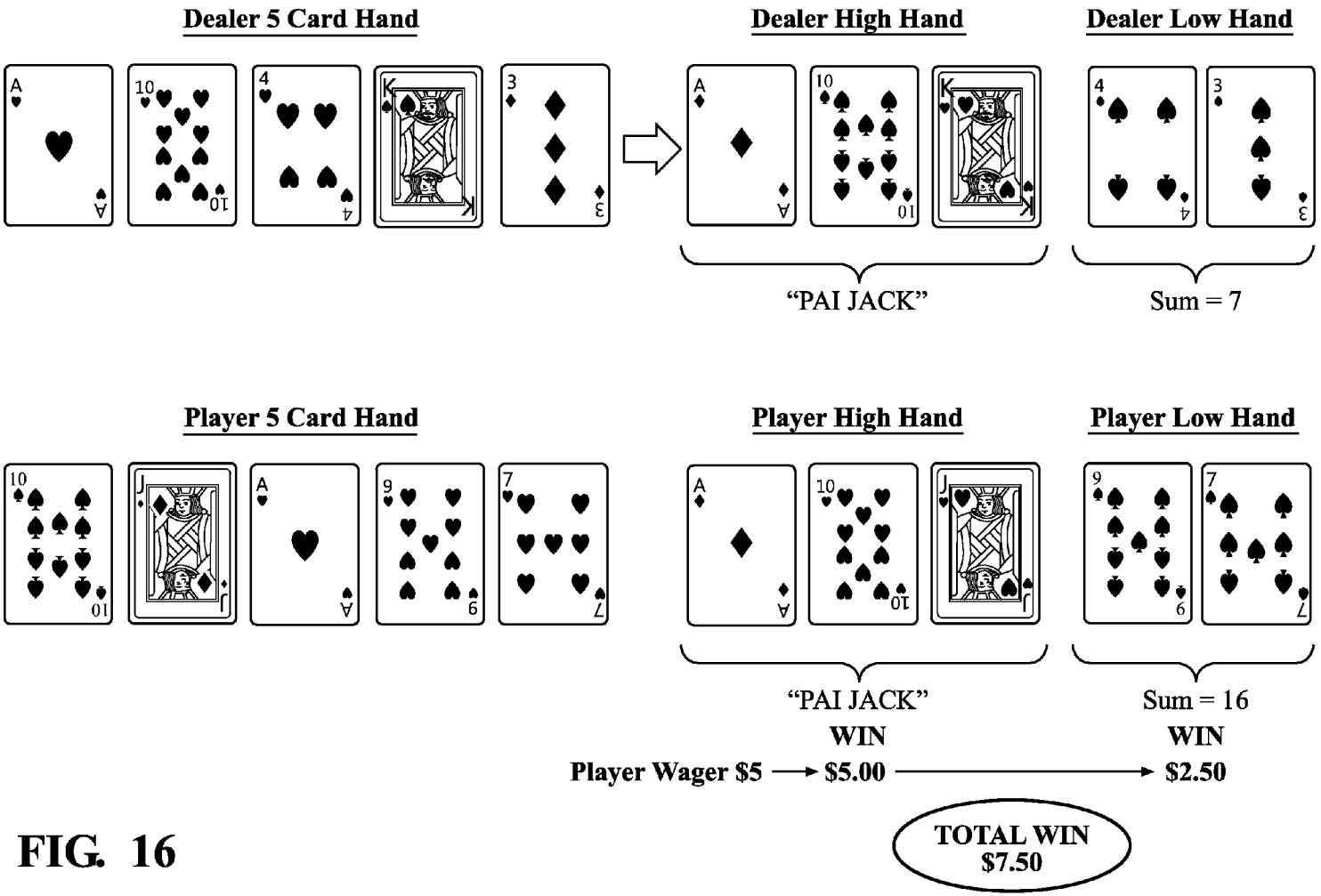
FIG. 16 is an exemplary depiction of a round of Pai Jack where the player's high hand contains a "Pai Jack" and automatically wins 1:1 on their initial on their original Pai Jack wager even though the dealer also has a "Pai Jack" and the player's low hand outranks the dealer's low hand resulting in a victory for the player.
Figure 17:
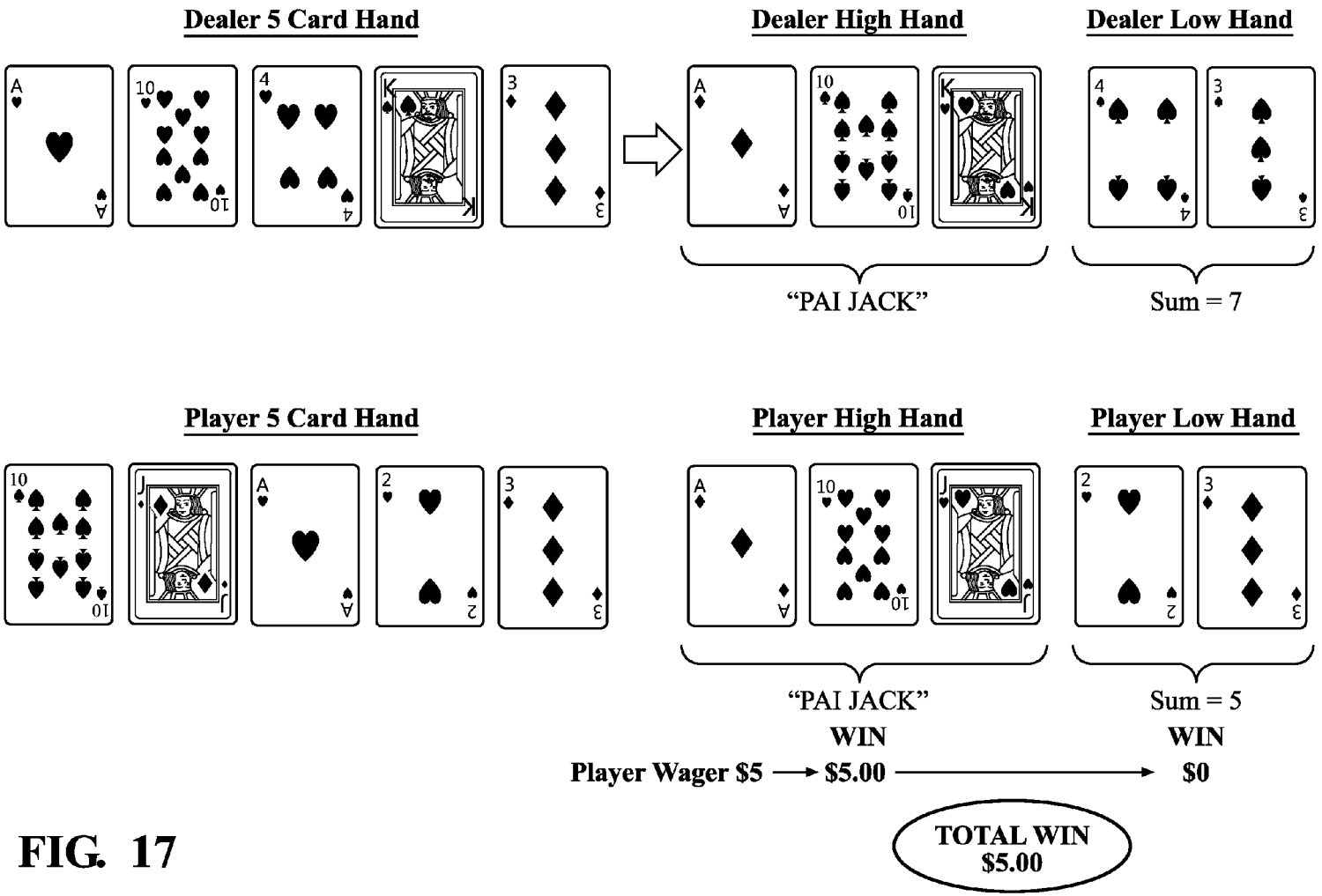
FIG. 17 is an exemplary depiction of a round of Pai Jack where the player's high hand contains a "Pai Jack" and the dealer also has a "Pai Jack" but the player's low hand is of lesser value than the dealer's low hand resulting in a partial player victory.

For example, in FIG. 16 the player's high hand contains a "Pai Jack" and automatically wins 1:1 on their initial Pai Jack wager even though the dealer also has a "Pai Jack". The player's low hand also outranks the dealer's low hand and the player is paid an extra unit bonus on the original wager for a total payout of 3:2 ($5 wager, payout $7.50). In FIG. 17, another illustrative example, the player's high hand contains a "Pai Jack" and automatically wins 1:1 on their initial on their original Pai jack wager even though the dealer also has a "Pai Jack". The player's low hand, however, is of lesser value than the dealer's low hand so the player is not paid an extra ½ unit bonus on the original wager. Total payout on this round of the Pai Jack game is 1:1 ($5 wager, payout $5).

In another example (not shown), the player places a $5 Pai Jack wager and receives a 5-card hand consisting of 10, jack, ace, 4, and 7. With this 5-card hand, the player can put the 10, jack, and ace in the high hand for a "Pai Jack" (10+10+1). The player then places the 4 and 7 in the low hand for a total of 11. In this case the player would automatically win 1:1 for having a Pai Jack. Thus on a Pai Jack wager of $5 the player would be guaranteed a win of $5 independent of the strength of the dealer's high hand. If the dealer's low hand had any value less than 11, then the player would win an extra half unit for a total payout of 3:2 since the player's low hand also outranks the total of the dealer's low hand. For a $5 wager, this would result in a payout of $7.50.

If the player has a "Pai Jack" and their low hand sum is equal or lower than the dealer's low hand sum, then the player stills win the automatic 1:1, but does not win the extra half unit. Thus in the above example where a player places a $5 initial wager and receives a "Pai Jack" and an 11 in their low hand, if the dealer's low-hand is 11 or greater the player would not beat the dealer. Thus the player wins $5 and does not receive the extra $2.50 half unit bonus.

Dealer "Pai Jack"

A dealer's 5-card hand that can be divided so as to achieve a high hand "Pai Jack" (two 10 valued cards and an ace), is not an automatic win for the dealer. Said another way, players do not automatically lose if the dealer has "Pai Jack". This is because a dealer "Pai Jack" never beats a player "Pai Jack". In contrast, if the dealer and the player both have a "Pai Jack" in their high hand, the player automatically wins 1:1 as per the method above. In addition, the player will win an extra half unit (3:2 total bonus) if their low hand total also outranks the dealer's low hand total. See FIG. 16.

Other than a player "Pai Jack", a dealer "Pai Jack" beats every other high hand including a player's high hand total of 21 (if the player's high hand total of 21 is not achieved through a "Pai Jack"). Accordingly, if the dealer has a "Pai Jack" in their high hand, and the player does not, then the player will always lose the high hand even when the player has a 21. Examples of three-card combinations that equal 21 include 8, 8, 5 and 6, 7, 8. As an example, a dealer with a high hand of 10, queen, ace (i.e. a "Pai Jack") would beat any player's high hand with a three card combination that equaled 21, such as 6, 7, 8.

In the event the dealer has a "Pai Jack", and the player does not, then the final outcome of the initial wager will be determined by comparing the relative strength of the player's low hand and the dealer's low hand. If the player's low hand is of higher value than the dealer's low hand, then player would push their original Pai Jack wager as they lost the high hand but won the low hand. If the player's low hand is of equal or lesser value than the dealer's low hand, then the player would their lose original Pai Jack wager as the player lost the high hand and either lost or pushed the dealer's low hand.

After all players reveal their hands, players who have busted will automatically lose their Pai Jack wager as described previously. The dealer will remove the player's busted hand and wager from the playing surface, and then reveal and set their high and low hands.

Determining the Outcome of the Primary Wager

The outcome of the primary wager, i.e., Pai Jack wager, may be resolved according to the various scenarios described above. The above outcomes can be illustrated in the following table which provides an exemplary algorithm to determine outcome of the primary Pai Jack wager according to one embodiment of the invention.

| High Hand | Low Hand | Outcome of Primary Wager |
|---|---|---|
| | WINNING HANDS | |
| Player Beats Dealer | Player Beats Dealer | Player Wins Wager |
| Player Does Not Bust and Dealer Busts | *Bust Not Applicable (not possible to exceed 21 in low hand) | Player Wins Wager |
| Player has Pai Jack | Player Loses or Ties Dealer | Player Wins Wager (Automatic win 1:1) |
| Player has Pai Jack | Player Beats Dealer | Player Wins Wager (Automatic win) and is paid at a Bonus 3:2) |
| | PUSHED HANDS | |
| Player Ties or Loses to Dealer | Player Beats Dealer | Player Pushes Wager |
| Player Beats Dealer | Player Ties or Loses to Dealer | Player Pushes Wager |
| | LOSING HANDS | |
| Player Loses to Dealer | Player Loses to Dealer | Player Loses Wager |
| Player Ties Dealer | Player Loses to Dealer | Player Loses Wager |
| Player Loses to Dealer | Player Ties Dealer | Player Loses Wager |
| Player Ties Dealer | Player Ties Dealer | Player Loses Wager |
| Player Sets Hands As A Foul | | **Player Loses Wager (unless House rules allow player to reset fouled hand) |

Further clarification of the resolution of the Pai Jack wager when the player and/or Dealer Have a Pai Jack is seen in the table below, which provides an exemplary algorithm to determine outcome of Pai Jack wager when the player and or dealer has a "Pai Jack".

| PLAYER "PAI JACK" | DEALER "PAI JACK" | LOW HAND OUTCOME | OUTCOME OF PRIMARY WAGER |
|---|---|---|---|
| YES | YES | Player Beats Dealer | Player Is Paid 3:2 |
| YES | NO | Player Loses to Dealer | Player Is Paid 1:1 |
| NO | YES | Player Beats Dealer | Player Pushes Wager |
| NO | YES | Player Ties or Loses to Dealer | Player Loses Wager |

Possible Variations of the Game

Variations of the present game may be constructed without departing from the spirit of this invention. For example, instead of only using blackjack rankings to determine the outcome of the wager, the outcome of the wager can be determined by a hybrid of poker hands and blackjack hands.

For example, the outcome of the wager can be decided by players arranging the high hand based on poker rankings and the low hand based on blackjack rankings. The reverse can also be done where the high hand is played using blackjack rankings and the low hand is played using poker rankings.

The same method will be employed to determine the outcome of the wager described in the previous modification, whereby a plurality of outcomes can occur by comparing the relative strength of the dealer's high hand and low hand to the player's high hand and low hand. The dealer will set their cards based on a determined "house way".

Hand strengths and settings will be reflective of the rules of the game the player follows. Thus, if player plays poker in their high hand and blackjack in their low hand, the dealer will play poker in their high hand and blackjack in their low hand as well. As such, consider the following scenario where the value of the high hand is based on poker rankings and the value of the low hand is based on blackjack rankings. The player receives a 5-card hand of 10, 10, jack, queen, and 7. The player's best 3-card poker hand is made by placing one of the 10's, the jack and the queen in the high hand for a straight, and the other 10 and 7 in the low hand for a 17. These hands would be compared to the dealer's respective high and low hands. Because the player's high hand was set based on poker rankings, the dealer will set their high hand based on poker rankings. Similarly, since the player's low hand was set using blackjack rankings, the dealer will set their low hand by blackjack rankings. The dealer compares their respective high and low hand to the player's high and low hand and resolves wagers according to the algorithm set forth for the modified game described above in the first modified version.

Additionally, by using a hybrid of poker and blackjack hands for setting the high and low hands respectively, the game can also be played with a total of 7 cards which is consistent with the traditional game of Pai Gow. In this version, players will use 5 of the 7 cards to create a high hand using poker rankings and the remaining 2 of the 7 cards will be placed in the low hand using blackjack rankings.

To those skilled in the art, other variations using different standards to rank the value of the high hand and low hand can be readily conceived, thereby not making the above exclusionary in nature.

Optional Side Wagers

Side wagers can be incorporated into the game through a variety of principles. One side wager for example is based on whether or not the numeric totals in the player's high and low hands are equal or "matched". A wager placed at the start of play, referred to as the Match Wager, will be resolved in favor of the player if the player's high and low card hands have the same sum. The Match Wager is resolved independently of the primary Pai Jack wager.

Figure 18:
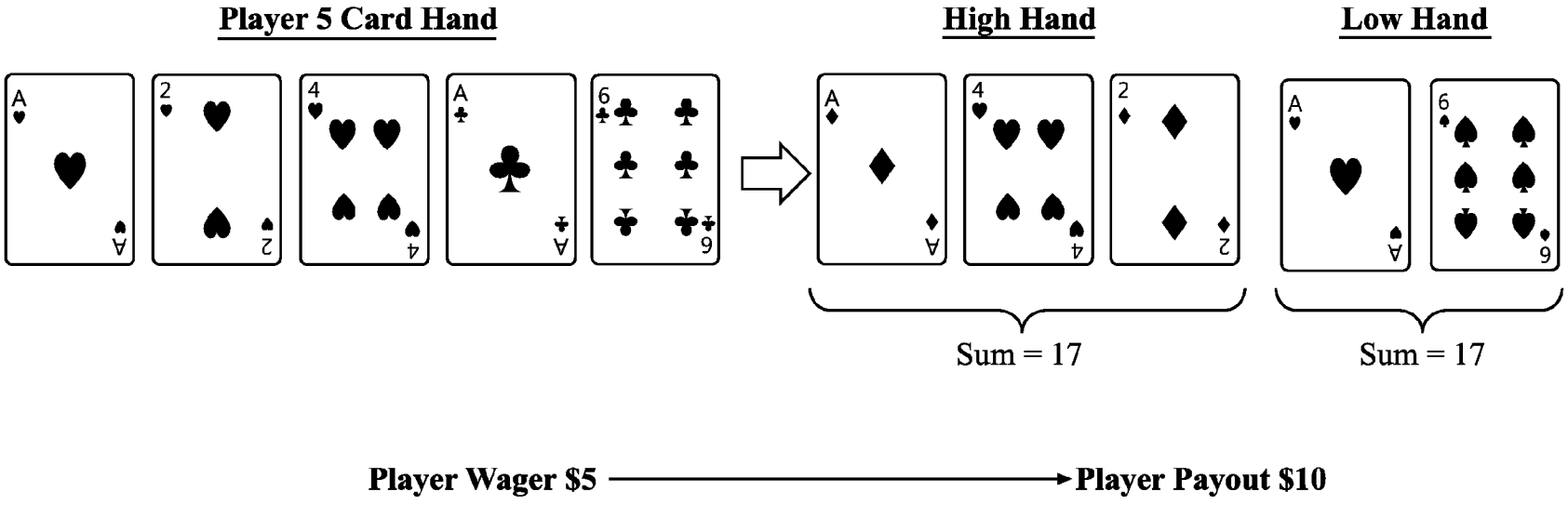
FIG. 18 is an exemplary depiction of an optional "Match" side wager.

FIG. 18 shows an example of the "Match" side wager whereby the player has a high hand and low hand of matching totals of 17. Matching high and low hand totals of any value other than 21 or "Pai Jack" are paid at an exemplary bonus of 2:1. So, for a $5 wager, the player receives a payout of $10.

As another example (not shown), if a player receives a 5-card hand of 10, 10, 8, 5, 3 they could divide their 5-cards such that they have an 18 (10+5+3) in the high hand and an 18 (10+8) in the low hand. This would be considered a match because the player arranged their cards in such a way that the total of the high and low hand are equal. The player can still play this hand on the main Pai Jack wager, as the player can set a high hand and a low hand that have an equal numeric value without fouling.

Figure 19:
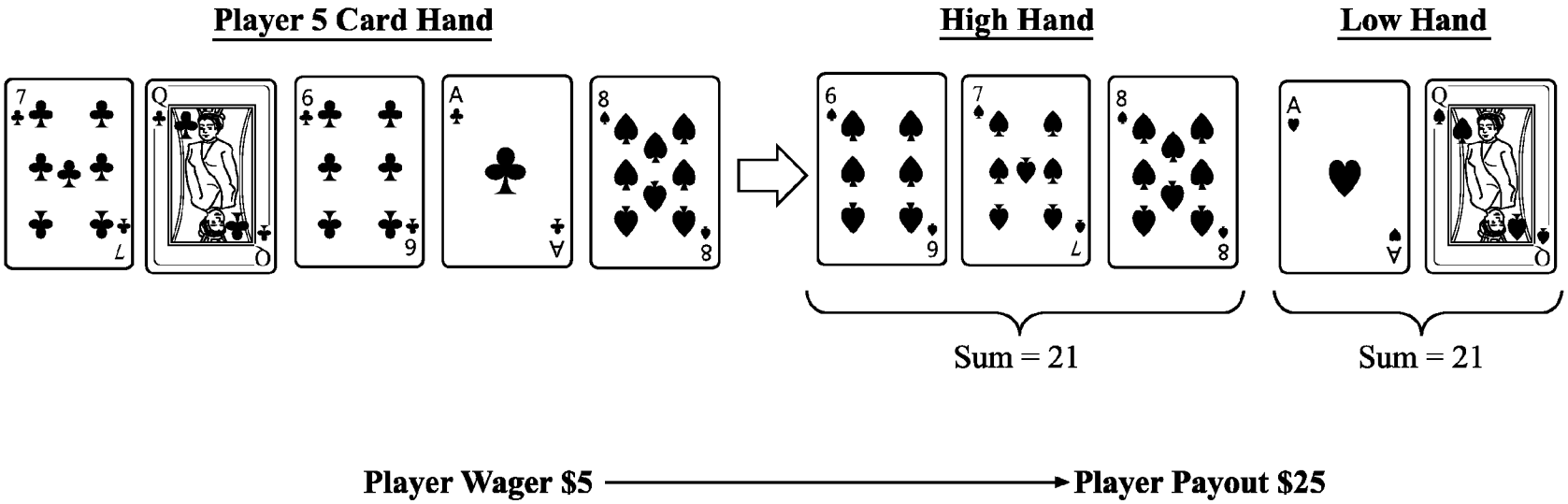
FIG. 19 is another exemplary depiction of the optional "Match" side wager.

The player can receive additional bonuses based on the strength of the hands that match. For example if a players top and bottom total matched they could be paid 2:1. If the player had a 21 in both the high and low hand this could be paid at a higher bonus such as 5:1. In FIG. 19, the player's high hand and low hand have matching totals of 21 which are paid at an exemplary bonus of 5:1. A $5 wager in this scenario earns a payout of $25.

Figure 20:
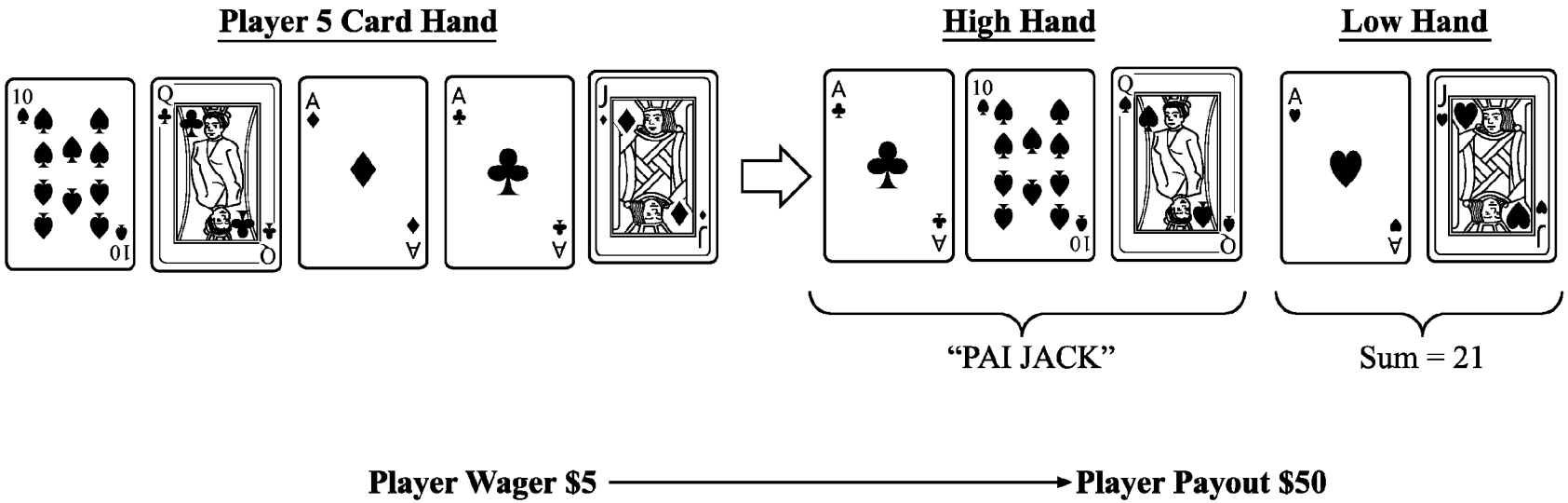
FIG. 20 is yet another exemplary depiction of an optional "Match" side wager.

A player with a "Pai Jack" in the high hand and a 21 in the low hand would be paid an even higher bonus such as 10:1. FIG. 20 depicts the player having a "Pai Jack" in their high hand and a 21 in their low hand which are paid at an exemplary bonus of 10:1. Thus, a $5 wager would yield a payout of $50.

Figure 21:
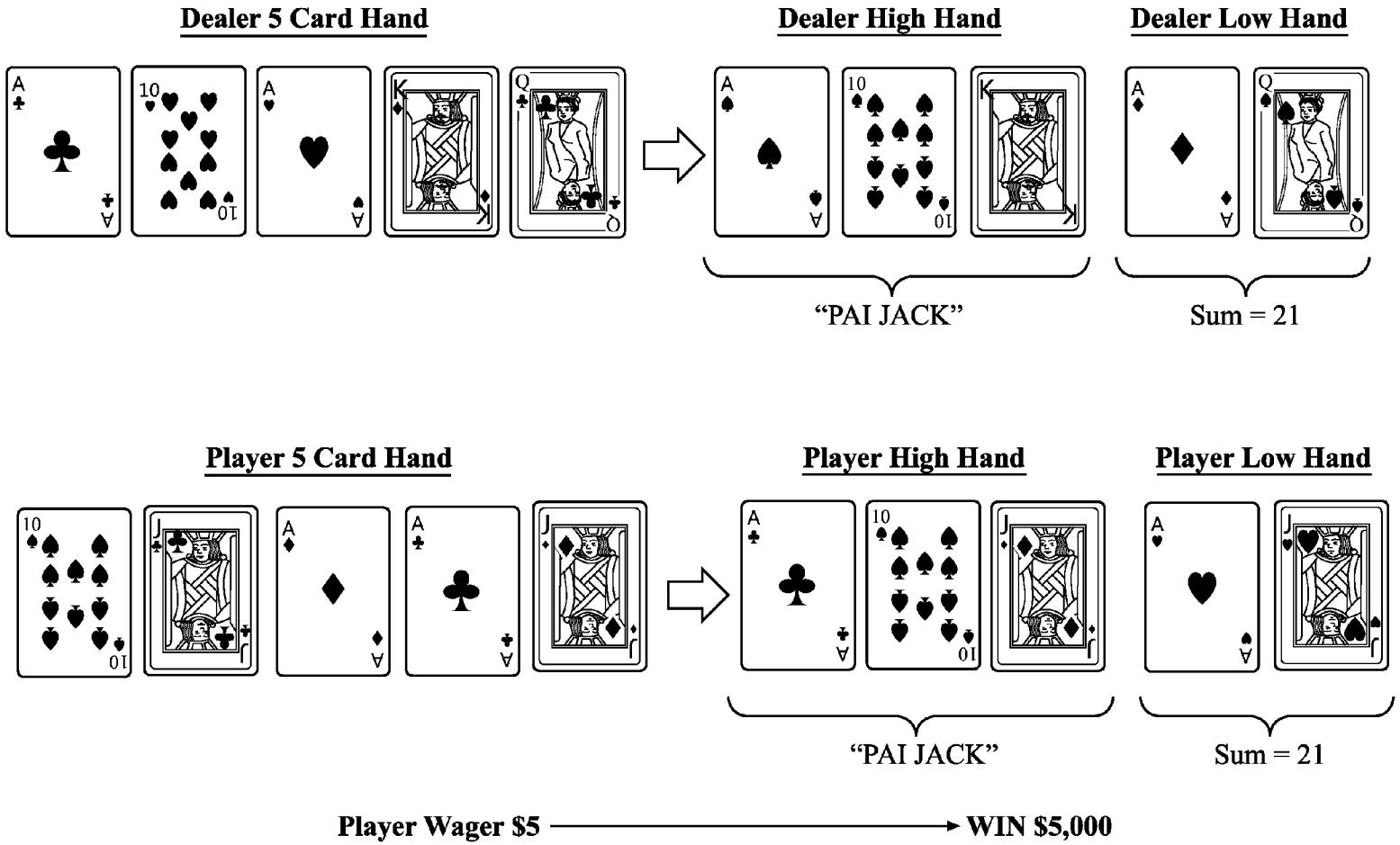
FIG. 21 is a still further example of the optional "Match" side wager.

The Match wager can be extended to include the outcome of the dealer's hand. Thus, if the dealer's high and low hand match the player can also be paid a bonus. A larger or even progressive bonus system can be applied as well, for hands where the player and dealer each have a "Pai Jack" in their high hand and a 21 in their low hand. A player with a "Pai Jack" in the high hand and a 21 in the low hand when the dealer also has a "Pai Jack" in the high hand and a 21 in the low hand would be paid an even higher bonus such as 1000:1. For example, FIG. 21 shows the player and dealer both having a "Pai Jack" in their high hand and a 21 in their low hand. If the payout of such an occurrence were set at 1000:1, a $5 wager would achieve a payout of $5,000. Similarly, the side wager could pay for "Pai Jacks" in the high hand and "blackjacks" (any 10 valued card and an ace) in the low hand. Naturally, many optional side wager combinations are possible.

Players could also be paid a bonus depending on the total sum of their 5-cards. This can be divided into a "high low" game where if the player's 5-card total is under a certain predetermined amount such as 20 then they receive a bonus. If their 5-card hand totals 21, this can also pay on the side wager. Initial 5-card hands over a certain point total such as 40 could also pay at a bonus. Other bonus schemas can be developed using these basic principles that would be readily apparent to those skilled in the art of using five, three, or two cards to create specific combinations.

Match Wager and Primary Wager: Strategy Decisions

The novel aspect of the combination of the Match and primary wagers is found player's ability to use their own strategy to determine the total value of their high and low hands such that they: are more likely to win the main wager and push or lose the match wager; will win the match wager but are more likely to lose the main wager; and will win the match wager and are more likely push or win the main wager.

Figure 22A:
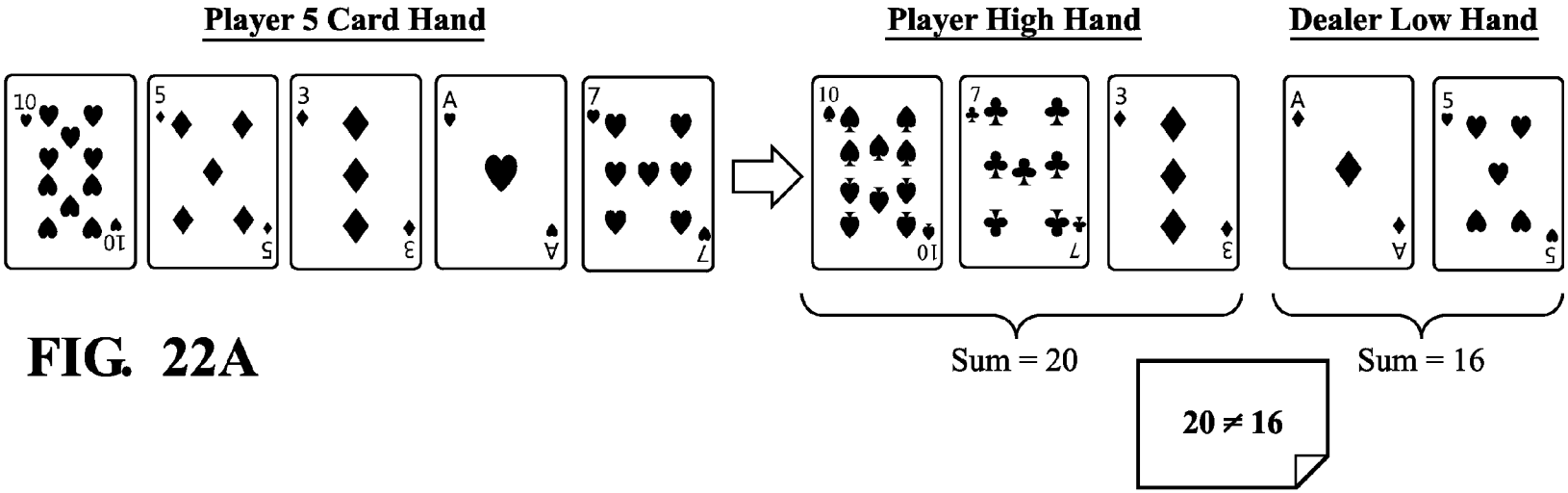
FIGS. 22A and 22B are exemplary depictions of play comparing alternative approaches to dividing the same 5-card hand into different high and low hands whereby in FIG. 22B the cards are arranged to achieve the optional side wager whereas in FIG. 22A they are not.
Figure 22B:
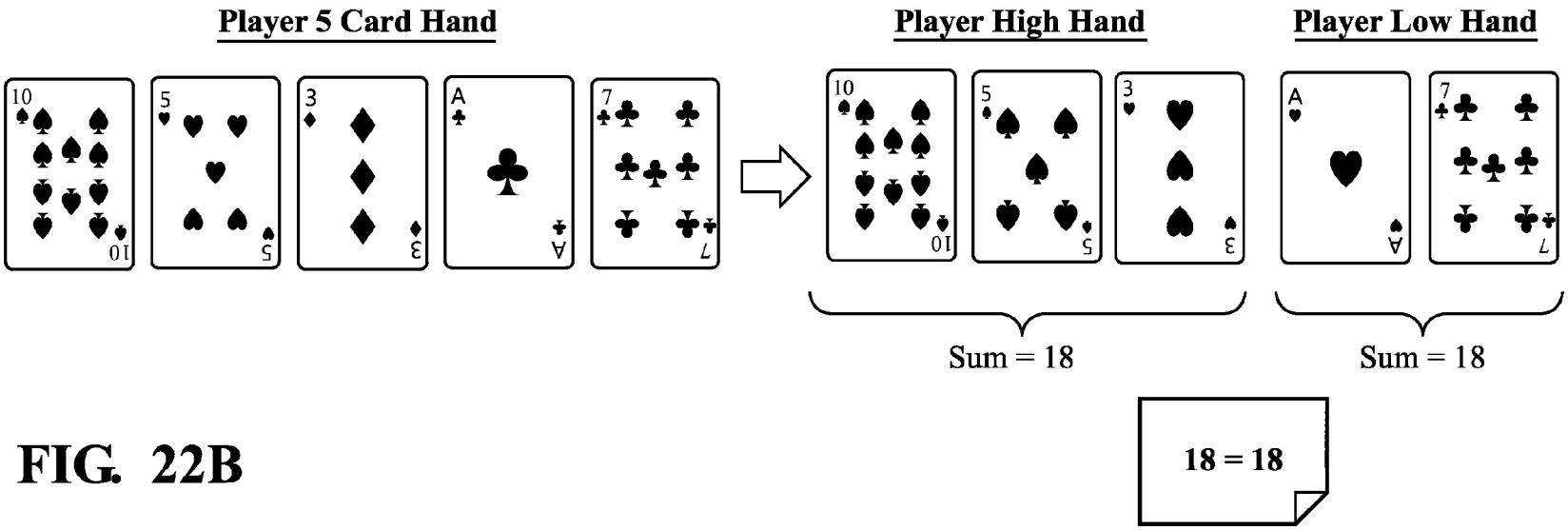

FIGS. 22A and 22B provide an illustrative example of how a player might choose to adopt a strategy of putting the highest three cards in the high hand and not matching the bottom hand vs. arranging the cards so the values of the top hand and bottom hand match.

For another example, consider a player's 5-card hand comprised of a 10, 5, 3, ace, and 7. Here the player can adopt the "house way" strategy and place the three cards together that make the strongest high hand and place the remaining two cards in the low hand. Using this strategy the player would place the 10, 7, and 3, in the high hand for a total of 20, and the ace, 5 in the low hand for a total of 16. This arrangement gives the strongest high hand but does not provide an arrangement where the totals match, as well as does not provide the player with the strongest low hand.

Thus, the player could instead set their hand in the following manner: 10, 5, and 3 in the high hand for a total of 18 and ace, 7 in their low hand also for a total of 18. This strategy allows the player to win the match wager (high hand total of 18 equals low hand total of 18) and also gives them a stronger total in the low hand by 2 points. Mathematically, losing a low hand with a total of 18 could be less likely than winning a high hand with a total of 20 obtained by puffing the 10, 7, and 3 in the high hand for 20 in the "house way" setting. This is likely given the high frequency of 3-card combinations that make 21 as well as the possibility that the dealer may have a "Pai Jack" in their high hand, making the 20 in a high hand no better than an 18.

In essence, the Match Wager allows the player to take the dealer out of the equation and simply play for the Match. Though the player would in some instances lose the main wager with this strategy, the goal or player strategy of first Matching the totals of their High and Low Hand before any other arrangements of cards are considered would guarantee them winnings given the match wager pays at a premium. Of course, it is contemplated that in some variations of the preferred embodiment players would be able to make the Match wager without playing the main game of Pai Jack against the dealer.

In summary, the present invention incorporates the rules of blackjack and Pai Gow into a novel single main wager in addition to including an innovative side wager. The game is attractive to players because the optional side wager and primary wager are resolved independently; and because the method of play preserves the distinctive nature of the wagers which allows players to incorporate individual strategy to make it more likely that they win the main wager, the optional side wager, or both.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. An electronically implemented method of playing a wagering game using images of playing cards, comprising:

providing an electronic gaming machine including at least one display screen configured to display images of playing cards; the electronic gaming machine including a non-transitory computer readable medium coded with instructions d executed by a processor to perform the steps of:

establishing playing positions on the display screen for a dealer and at least one player;

providing electronically producible images of at least one standard deck of 52 playing cards with respective faces designated in ascending numerical sum 2-10, J, Q, K, A each in four suits; assigning a numerical value to each card, said numerical value being equivalent to the face value for cards designated 2-10, said numerical value being ten for cards designated J, Q, K, and said numerical value being one or eleven for cards designated A;

accepting a primary wager from the player;

dealing the player and a dealer each five cards;

requiring the player and the dealer to arrange their respective five cards into a three-card high hand and a two-card low hand, said requiring step including prohibiting the numerical sum of the high hand to exceed a value of 21;

comparing the numerical sum of the dealer's three-card high hand to the numerical sum of the player's three-card high hand and comparing the numerical sum of the dealer's two-card low hand to the numerical sum of the player's two-card low hand;

settling the player's primary wager dependent upon the comparison of the numerical sum of the dealer's three-card high hand to the numerical sum of the player's three-card card high hand and the comparison of the numerical sum of the dealer's two-card low hand to the numerical sum of the player's two-card low hand; said settling step including confiscating the player's primary wager if the numerical sum of the dealers three-card high hand and two-card low hand is higher than the player's three-card high hand and two-card low hand respectively, and paying the player a winning payout associated with the primary wager if the numerical sum of the player's three-card high hand and two-card low hand is higher than the dealer's three-card high hand and two-card low hand respectively, and allowing the player to retain their primary wager if the numerical sum of the player's three-card high hand or two-card low hand, but not both, is higher than the dealer's three-card high hand or two-card low hand respectively, wherein said settling step additionally includes establishing a ranking hierarchy for the high hand in which a numerical sum of 21 achieved through the combination of two ten-valued cards and one A is greater than a numerical sum of 21 achieved through any other possible combination of three cards.

2. The method of claim 1 further including accepting a side wager from the player, and settling the side wager in favor of the player if the numerical sum of the player's three-card high hand matches the numerical sum of the player's two-card low hand.

3. The method of claim 2 wherein said step of settling the side wager in favor of the player includes the numerical sums of both the player's three-card high hand and two-card low hand is 21.

4. The method of claim 1 wherein said step of settling the primary wager in favor of the player includes both the player and the dealer having respective high hands with numerical sums of 21 achieved through the combination of two ten-valued cards and one A.

5. The method of claim 1 further including accepting a side wager from the player, and settling the side wager in favor of the player if the numerical sum of the five cards received by the player in connection with said dealing step is 21.

6. The method of claim 1, wherein said step of settling the primary wager in favor of the dealer includes a player bust where the player cannot form a three-card high hand with a numerical sum less than or equal to 21.

7. The method of claim 1, wherein said step of settling the primary wager in favor of the player includes a dealer bust where the dealer cannot form a three-card high hand with a numerical sum less than or equal to 21.

8. The method of claim 1, wherein said step of requiring the dealer to arrange the five cards into a three-card high hand and a two-card low hand includes requiring the dealer to form the high hand with the greatest possible numeric value less than 22 and placing the remaining two cards in the low hand.

9. The method of claim 1, wherein said step of requiring the player to arrange their respective five cards into a three-card high hand and a two-card low hand includes interacting with a touch screen interface.

* * * * *